US007230177B2

(12) United States Patent
Kawashima

(10) Patent No.: US 7,230,177 B2
(45) Date of Patent: Jun. 12, 2007

(54) INTERCHANGE FORMAT OF VOICE DATA IN MUSIC FILE

(75) Inventor: Takahiro Kawashima, Hamakita (JP)

(73) Assignee: Yamaha Corporation, Hamamatsu-shi (JP)

( * ) Notice: Subject to any disclaimer, the term of this patent is extended or adjusted under 35 U.S.C. 154(b) by 383 days.

(21) Appl. No.: 10/715,921

(22) Filed: Nov. 17, 2003

(65) Prior Publication Data

US 2004/0099126 A1 May 27, 2004

(30) Foreign Application Priority Data

Nov. 19, 2002 (JP) ..... 2002-335233

(51) Int. Cl.
*G10H 1/36* (2006.01)
*G10H 7/00* (2006.01)

(52) U.S. Cl. ..... 84/610; 84/609; 84/622; 84/625; 84/634

(58) Field of Classification Search ..... None
See application file for complete search history.

(56) References Cited

U.S. PATENT DOCUMENTS

| | | | | |
|---|---|---|---|---|
| 4,527,274 | A * | 7/1985 | Gaynor | 704/267 |
| 5,680,512 | A * | 10/1997 | Rabowsky et al. | 704/504 |
| 5,703,311 | A * | 12/1997 | Ohta | 84/622 |
| 5,747,715 | A * | 5/1998 | Ohta et al. | 84/609 |
| 5,750,912 | A * | 5/1998 | Matsumoto | 84/609 |
| 6,836,761 | B1 * | 12/2004 | Kawashima et al. | 704/258 |
| 6,999,752 | B2 | 2/2006 | Fukaya | |

FOREIGN PATENT DOCUMENTS

| | | |
|---|---|---|
| EP | 0 542 628 A2 | 5/1993 |
| JP | H01-186977 | 7/1989 |
| JP | H02-29797 | 1/1990 |
| JP | H02-113299 | 4/1990 |
| JP | 4-175049 | 6/1992 |
| JP | HEI14-251297 | 9/1992 |
| JP | 5-233565 | 9/1993 |
| JP | 9-50287 | 2/1997 |
| JP | H09-050287 | 2/1997 |
| JP | 10-143170 | 5/1998 |

(Continued)

*Primary Examiner*—Marlon Fletcher
(74) *Attorney, Agent, or Firm*—Morrison & Foerster LLP

(57) ABSTRACT

A music apparatus has a data storage, a controller and a sound generator for reproducing a music sound and a voice sound. The data storage stores a music data file containing a music part and a voice part, the music part containing a sequence of music generation events effective to instruct generation of the music sound, the voice part containing voice reproduction sequence data composed of a combination of voice reproduction event data and duration data, the voice reproduction event data instructing reproduction of a sequence of voice events, the duration data specifying a timing of effecting a voice event in terms of a duration time measured from another voice event preceding to the voice event. The controller reads out the music data file from the data storage. The sound generator operates based on the music part contained in the read music data file for generating the music sound representative of the sequence of the music events, and operates based on the voice part contained in the read music data file for generating the voice sound representative of the sequence of the vice events, thereby mixing and outputting the music sound and the voice sound.

13 Claims, 13 Drawing Sheets

FOREIGN PATENT DOCUMENTS

| | | |
|---|---|---|
| JP | 10-319955 | 12/1998 |
| JP | 11-015489 | 2/1999 |
| JP | 11-282483 | 10/1999 |
| JP | 2000-099056 | 4/2000 |
| JP | 2000-26424 | 5/2000 |
| JP | 2001-282815 | 10/2001 |
| JP | 2002-132282 | 5/2002 |
| JP | 2002-74503 | 9/2002 |

* cited by examiner

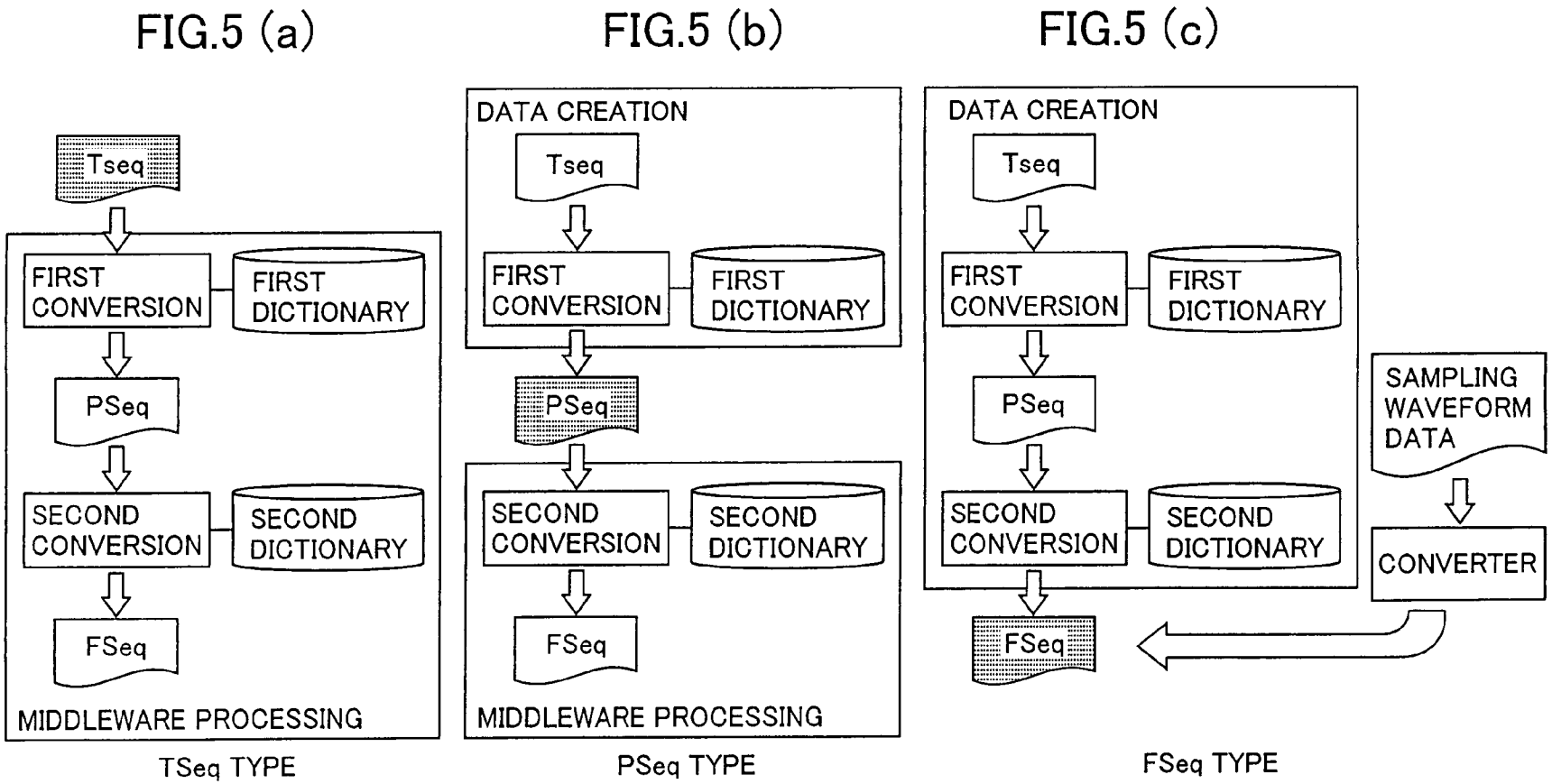
FIG.5 (a)
Tseq
FIRST CONVERSION
FIRST DICTIONARY
PSeq
SECOND CONVERSION
SECOND DICTIONARY
FSeq
MIDDLEWARE PROCESSING
TSeq TYPE
FIG.5 (b)
DATA CREATION
Tseq
FIRST CONVERSION
FIRST DICTIONARY
PSeq
SECOND CONVERSION
SECOND DICTIONARY
FSeq
MIDDLEWARE PROCESSING
PSeq TYPE
FIG.5 (c)
DATA CREATION
Tseq
FIRST CONVERSION
FIRST DICTIONARY
PSeq
SECOND CONVERSION
SECOND DICTIONARY
FSeq
SAMPLING WAVEFORM DATA
CONVERTER
FSeq TYPE TSeq Sample

```
<LJAPANESE
<CS-JIS
<G4
<V1000
<N64
<P1000
<Tい'や———、き__ょー__わ'さ__むい__ねー。
<P1500
<Tご'のままい__ったら、は'ちが__つわ、たいへ'ん__やねー。
<Q
```

RELATION BETWEEN GATE TIME LENGTH AND DELAY TIME

INTERCHANGE FORMAT OF VOICE DATA IN MUSIC FILE

BACKGROUND OF THE INVENTION

1. Field of the Invention

This invention relates to a data interchange format of voice sequence data, a music sound and voice reproducing apparatus, and a server apparatus of a music data file containing voice sequence data.

2. Description of Prior Art

A standard MIDI file format (SMF) and a synthetic music mobile application format (SMAF) have already been known as data interchange formats for use in distributing or mutually exchanging data representing music applied to a sound generator. SMAF is a data format specification for representing multimedia contents in a portable terminal or the like (See non-patent literature 1).

SMAF will now be described hereinafter by referring to FIG. 15.

In this diagram, there is shown an SMAF file 100, provided with data blocks referred to as chunks in a basic structure. A chunk comprises a fixed-length (8-byte) header and an appropriate length body. The header is further separated into a 4-byte chunk ID and a 4-byte Chunk Size. The chunk ID is used for a chunk identifier and the Chunk Size indicates a length of the body. The SMAF file has a chunk structure and each of various data included in the SMAF file has also the chunk structure.

As shown in the drawing, a content of the SMAF file 100 comprises a contents info chunk 101 containing management information and one or more track chunks 102 to 108 including sequence data which will be fed to an output device. The sequence data is a data representation in which controls to the output device are defined in the order of time passage. All sequence data included in the single SMAF file 100 are set to start reproduction of multimedia simultaneously at time 0. Consequently, all sequence data of multimedia are reproduced in synchronization with each other.

Sequence data is represented by a combination of an event and duration. The event is a data representation of a content of a control applied to an output device corresponding to a media type of the sequence data. The duration is data representing a duration time between a preceding event and a succeeding event. Although processing time required for an event is not actually zero, it is assumed zero in the SMAF data representation and every time flow is represented by the duration. Timing for executing an event can be uniquely determined by integrating the duration time from the beginning of the sequence data. Processing time consumed for an event does not affect a start time for processing of the next event in principle, since the processing time is very short as compared to the duration time. Therefore, sequential events with a value 0 between them are interpreted to be executed simultaneously.

In SMAF, as the output devices, there are defined a sound generator device 111 for generating sounds with control data equivalent to a musical instrument digital interface (MIDI), a PCM sound generator device (PCM decoder) 112 for acoustically reproducing PCM data, and a display device 113 such as an LCD for displaying texts or images.

The track chunks include music score track chunks 102 to 105, a PCM audio track chunk 106, a graphics track chunk 107, and a master track chunk 108 in correspondence to the respective output devices. In this connection, the track chunks other than the master track chunk, namely, the score track chunks, the PCM audio track chunk, and the graphics track chunk can be described up to a maximum of 256 tracks.

In the shown example, the music score track chunks 102 to 105 contain music sequence data for commencing the sound generator device 111, the PCM track chunk 106 contains wave data such as ADPCM, MP3, and TwinVQ reproduced by the PCM sound generator device 112 in event sequential format, and the graphics track chunk 107 contains a background image, an inserted still image, text data, and sequence data for reproducing them by using the display device 113. The master track chunk 108 contains sequence data for controlling the SMAF sequencer itself.

On the other hand, as a technique for a sound synthesis, there are known a filter synthesis such as LPC, a composite sinusoid speed synthesis, and other waveform synthesis methods. In the composite sinusoid speed synthesis method (CSM method), a speech signal is modeled with a sum of a plurality of sine waves for speech synthesis. It is a simple synthesis method and yet offers high-quality speech synthesis (See non-patent literature 2).

In addition, there has been suggested a voice synthesizer for generating a singing voice by synthesizing voices with a sound generator (See non-patent literature 1).

The non-patent literature 1 is a SMAF specification, Ver. 3.06, Yamaha Corporation, [Searched for on Oct. 18, 2002.], Internet <URL: http://smaf.yamaha.co.jp>

The Non-patent Literature 2 is Shigeki Sagayama and Fumitada Itakura, "Some Investigation of Composite Sinusoid Speech Synthesis and Prototype Hardware Realization," ASJ Trans. of the Com. on Speech Res., S80-12, pp. 93-100, May 1980

Other prior art document is Patent Literature 1, namely, Japanese Unexamined Patent Publication (Kokai) No. 9-50827

As set forth hereinabove, SMAF includes MIDI-equivalent data (music data), PCM audio data, text or image display data, and other various sequence data, and the entire multimedia sequence can be reproduced synchronously on the common time base.

In SMF and SMAF, however, a representation of a voice (human voice) is not defined. Accordingly, there can be a method of extending MIDI such that voices may be synthesized by extending a MIDI event in SMF or the like. In this condition, however, there is a problem that data processing is complicated when selectively taking out a voice part at a time and synthesizing the voices.

SUMMARY OF THE INVENTION

Accordingly, it is an object of the present invention to provide a data interchange format of multimedia sequence data having flexibility and enabling a reproduction of a voice sequence in synchronization with a music sequence or the like, a sound reproducing apparatus capable of reproducing a music and voice file in the data interchange format, and a server apparatus capable of distributing music and voice data in the data interchange format.

In order to achieve the above noted objects, there is provided an inventive apparatus for reproducing a music sound and a voice sound, comprising a first storing section that stores a music data file containing a music part and a voice part, the music part containing a sequence of music generation events effective to instruct generation of the music sound, the voice part containing voice reproduction sequence data composed of a combination of voice reproduction event data and duration data, the voice reproduction event data instructing reproduction of a sequence of voice events, the duration data specifying a timing of effecting a voice event in terms of a duration time measured from another voice event preceding to the voice event, a control section that reads out the music data file from the first storing section, and a sound generator section that operates based on the music part contained in the read music data file for generating the music sound representative of the sequence of the music events, and that operates based on the voice part contained in the read music data file for generating the voice sound representative of the sequence of the vice events, thereby mixing and outputting the music sound and the voice sound.

In a specific form, the voice reproduction sequence data contains formant control information for generating formants of the voice sound, and the voice reproduction event data contained in the voice part of the read music data file instructs reproduction of the formant control information, so that the sound generator section operates based on the formant control information which is contained in the voice reproduction sequence data and which is specified by the voice reproduction event data for generating the voice sound.

In another specific form, the inventive apparatus further comprises a second storing section that stores first dictionary data which records correspondence between text information representing words to be pronounced as the voice sound and phoneme information representing phonemes of the words, and correspondence between prosodic symbols representing vocal expressions applied to pronunciation of the words and prosodic control information for controlling the vocal expressions, and a third storing section that stores second dictionary data which records correspondence between a combination of the phoneme information and associated prosodic control information representing the voice sound to be reproduced, and formant control information used for generating formants of the voice sound, wherein the control section reads out the music data file having the voice part containing the voice reproduction event data of a text description type which instructs reproduction of the voice sound represented by the text information and associated prosodic symbols, then the control section refers to the first dictionary data stored in the second storing section for acquiring therefrom the phoneme information and associated prosodic control information corresponding to the text information and associated prosodic symbols, and further refers to the second dictionary data stored in the third storing section for reading out therefrom the formant control information corresponding to the acquired phoneme information and associated prosodic control information, so that the sound generator section operates based on the read formant control information for generating the voice sound.

In still another specific form, the inventive apparatus further comprises a second storing section that stores dictionary data which records correspondence between a combination of phoneme information and associated prosodic control information, and formant control information, the phoneme information representing phonemes of the voice sound to be reproduced, the associated prosodic control information being capable of controlling vocal expressions of the phonemes, the formant control information being capable of generating formants of the voice sound, wherein the control section operates when the voice reproduction event data contained in the voice part of the read music data file instructs reproduction of information of a phoneme description type containing the phoneme information and associated prosodic control information corresponding to the voice sound to be reproduced, for referring to the dictionary data stored in the second storing section to acquire therefrom the formant control information corresponding to the phoneme information and associated prosodic control information which are specified by the voice reproduction event data, so that the sound generator section operates based on the acquired formant control information for generating the voice sound.

Specifically, the first storing section stores the music data file containing the voice part of a first format type, the sound generator section is operable based on the voice part of a second format type for generating the voice sound, and the control section detects a format type of the voice part read from the first storing section and operates if the detected first formant type of the voice part is not compatible with the second format type for converting the read voice part from the first format type to the second format type, thereby enabling the sound generator section.

Further, the inventive apparatus comprise a second storing section that stores dictionary data required for conversion of the format type of the voice part of the music data file, so that the control section refers to the dictionary data stored in the second storing section for effecting the conversion of the format type of the voice part.

Preferably, the voice part of the music data file contains data specifying a kind of language of the voice part.

Practically, the sound generator section operates based on the voice part of the music data file for generating the voice sound representative of a human voice.

The invention includes a memory medium for storing voice reproduction sequence data designed for causing a sound generator device to reproduce a human voice, wherein the voice reproduction sequence data has a chunk structure composed of a content information chunk containing information for managing the voice reproduction sequence data and at least one track chunk containing voice sequence data, and wherein the voice sequence data comprises a sequence of pairs of voice reproduction event data and duration data, the voice reproduction event data instructing a voice reproduction event of the human voice, the duration data specifying a timing of executing the voice reproduction event in terms of a duration time measured from a preceding voice reproduction event.

Specifically, the voice reproduction event data is one of a text description type, a phoneme description type and a formant frame description type, the text description type of the voice reproduction event data containing text information specifying words to be pronounced by the sound generator device as the human voice and associated prosodic symbols specifying vocal expression applied to pronunciation of the words, the phoneme description type of the voice reproduction event data containing phoneme information specifying phonemes of the human voice to be reproduced by the sound generator device and associated prosodic control information controlling vocal expressions of the phonemes, the formant frame description type of the voice reproduction event data containing formant control information specifying formants of the human voice at respective time frames.

The invention includes another memory medium for storing sequence data for causing a sound generator device to reproduce a music sound and a human voice, wherein the sequence data has a data structure composed of music sequence data and voice reproduction sequence data, the music sequence data comprising a sequence of pairs of music generation event data and duration data, the music generation event data instructing a music generation event of the music sound, and the duration data specifying a timing of executing the music generation event in terms of a duration time measured from a preceding music generation event, and the voice reproduction sequence data comprising a sequence of pairs of voice reproduction event data and duration data, the voice reproduction event data instructing a voice reproduction event of the human voice, and the duration data specifying a timing of executing the voice reproduction event in terms of a duration time measured from a preceding voice reproduction event, whereby the music sequence data and the voice reproduction sequence data are concurrently processed by the sound generator device so as to reproduce the music sound and the human voice along a common time axis.

Preferably, the sequence data has a chunk structure such that the music sequence data and the voice reproduction sequence data are arranged at different chunks.

Specifically, the voice reproduction event data is one of a text description type, a phoneme description type and a formant frame description type, the text description type of the voice reproduction-event data containing text information specifying words to be pronounced by the sound generator device as the human voice and associated prosodic symbols specifying vocal expression applied to pronunciation of the words, the phoneme description type of the voice reproduction event data containing phoneme information specifying phonemes of the human voice to be reproduced by the sound generator device and associated prosodic control information controlling vocal expressions of the phonemes, the formant frame description type of the voice reproduction event data containing formant control information specifying formants of the human voice at respective time frames.

The invention also includes a server apparatus comprising a storing section and a transmitting section, wherein the storing section stores a music data file containing a music part and a voice part, the music part containing a sequence of music generation events effective to instruct generation of the music sound, the voice part containing voice reproduction sequence data composed of a combination of voice reproduction event data and duration data, the voice reproduction event data instructing reproduction of a sequence of voice events, the duration data specifying a timing of effecting a voice event in terms of a duration time measured from another voice event preceding to the voice event, and the transmitting section responds to a request from a client terminal apparatus for distributing the stored music data file to the client terminal apparatus.

Specifically, the voice reproduction event data is one of a text description type, a phoneme description type and a formant frame description type, the text description type of the voice reproduction event data containing text information specifying words to be pronounced by the sound generator device as the human voice and associated prosodic symbols specifying vocal expression applied to pronunciation of the words, the phoneme description type of the voice reproduction event data containing phoneme information specifying phonemes of the human voice to be reproduced by the sound generator device and associated prosodic control information controlling vocal expressions of the phonemes, the formant frame description type of the voice reproduction event data containing formant control information specifying formants of the human voice at respective time frames.

BRIEF DESCRIPTION OF THE DRAWINGS

FIGS. 5(*a*) through 5(*c*) are diagrams for explaining three format types: (*a*) TSeq type, (*b*) PSeq type, and (*c*) FSeq type.

DETAILED DESCRIPTION OF THE INVENTION

Figure 1:
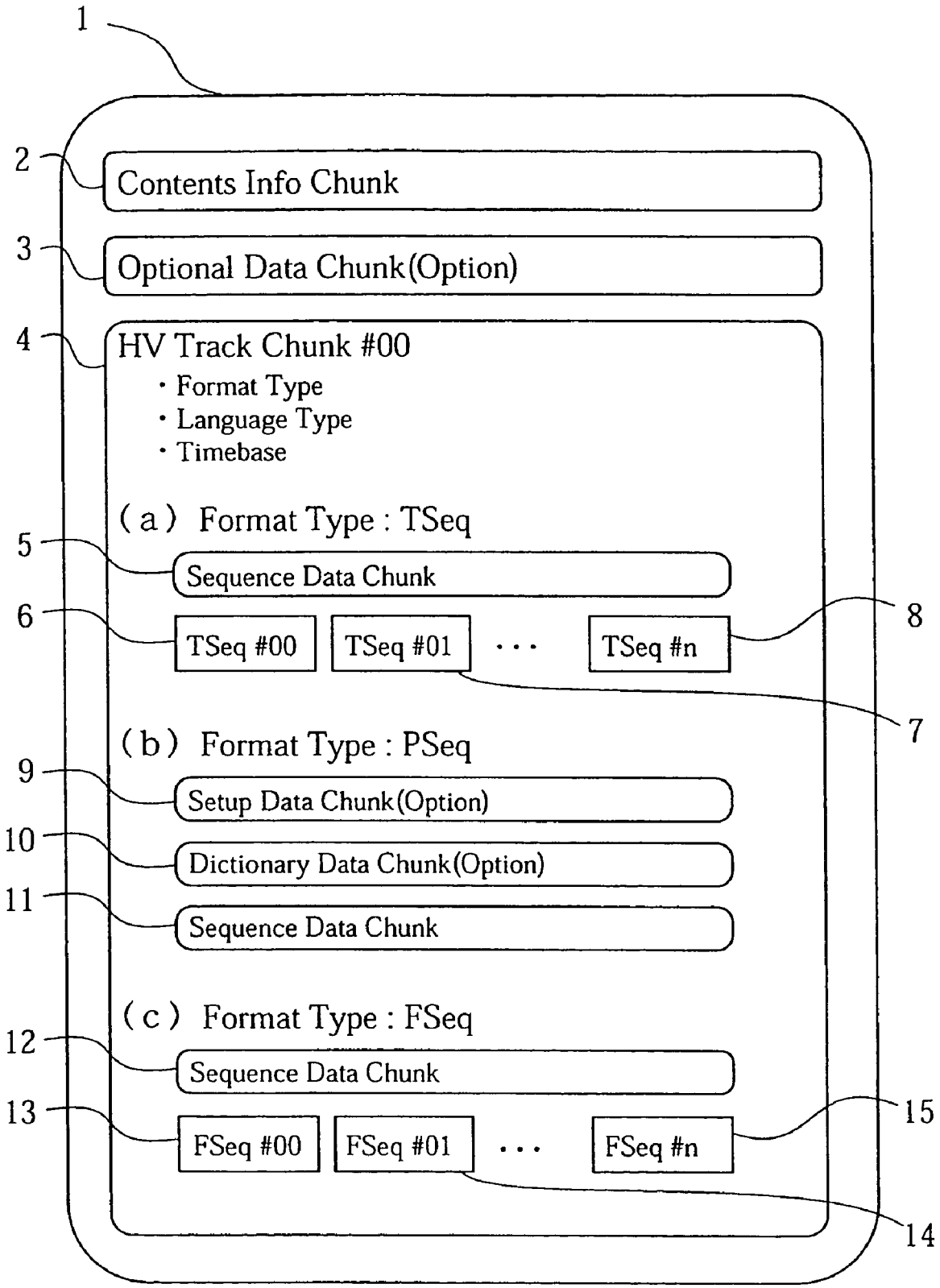
FIG. 1 is a diagram showing an embodiment of a data interchange format of voice reproduction sequence data according to the present invention.

Referring to FIG. 1, there is shown a diagram of an embodiment of a data interchange format of a voice reproduction sequence in the present invention. In this diagram, there is shown a file 1 having the data interchange format of the present invention. The file 1 has a chunk structure as a basic construction similarly to the SMAF file described above, having a header and a body (a file chunk).

The header contains a file ID (chunk ID) for identifying the file and a Chunk Size indicating a length of the subsequent body.

The body is a chunk string. In the shown example, it contains a contents Info chunk 2, an optional data chunk 3, and a human voice (HV) track chunk 4 including a voice reproduction sequence data. It should be noted here that the file 1 can contain a plurality of HV track chunks 4, though only the single HV track chunk #00 is described as the HV track chunk 4 in FIG. 1.

Furthermore, in the present invention, three format types (TSeq, PSeq, and FSeq types) are defined as voice reproduction sequence data included in the HV track chunk 4. They are described later.

The contents Info chunk 2 contains management information such as a class, a type, copyright information, a genre name, a music title, an artist name, and a lyric writer/composer name of the contents contained in the file. Furthermore, the optional data chunk 3 can be provided for storing the above information, namely, the copyright information, the genre name, the music title, the artist name, and the lyric writer/composer name.

While the data interchange format of the voice reproduction sequence shown in FIG. 1 can be independently used to reproduce the voice sound such as human voice, the HV track chunk 4 can be included in the above SMAF file as one of the data chunks.

Figure 2:
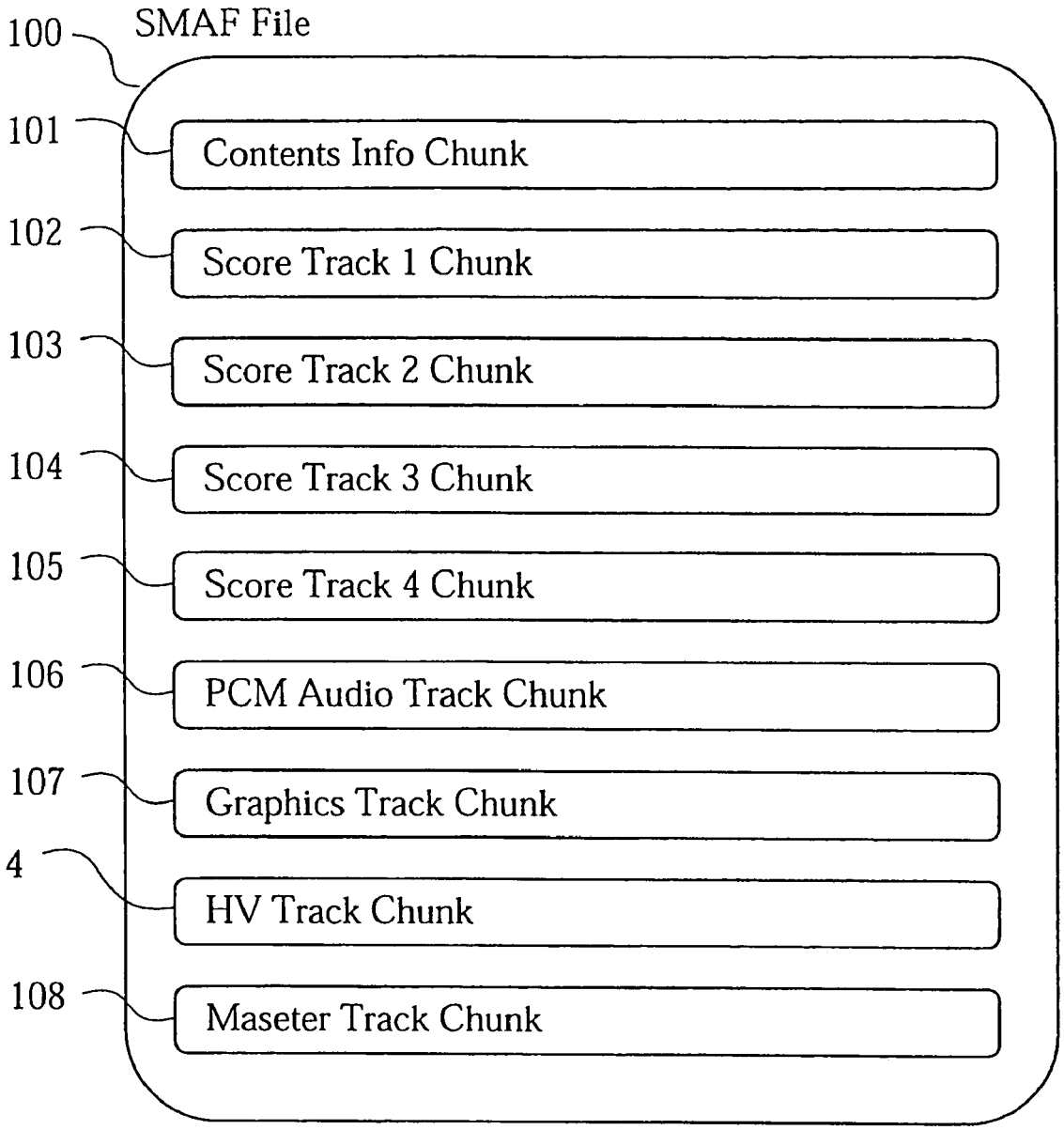
FIG. 2 is a diagram showing an example of an SMAF file in which an HV track chunk is included as one of data chunks.

Referring to FIG. 2, there is shown a diagram of a file structure having the data interchange format of the sequence data according to the present invention, including the above HV track chunk 4 as one of the data chunks. This file can be said to be an extended SMAF file arranged in such a way as to include the voice reproduction sequence data.

In this diagram of FIG. 2, the extended SMAF file 100 comprises a contents info chunk 101 containing management information and one or more track chunks 102 to 108 including sequence data which will be fed to an output device. The sequence data is a data representation in which controls to the output device are defined in the order of time passage. All sequence data included in the single SMAF file 100 are set to start reproduction of multimedia simultaneously at time 0. Consequently, all sequence data of multimedia are reproduced in synchronization with each other.

Sequence data is represented by a combination of an event and duration. The event is a data representation of a content of a control applied to an output device corresponding to a media type of the sequence data. The duration is data representing a duration time between a preceding event and a succeeding event. Although processing time required for an event is not actually zero, it is assumed zero in the extended SMAF data representation and every time flow is represented by the duration. Timing for executing an event can be uniquely determined by integrating the duration time from the beginning of the sequence data. Processing time consumed for an event does not affect a start time for processing of the next event in principle, since the processing time is very short as compared to the duration time. Therefore, sequential events with a value 0 between them are interpreted to be executed simultaneously.

The extended SMAF may define various output devices such as a sound generator device for generating sounds with control data equivalent to a musical instrument digital interface (MIDI), a PCM sound generator device (PCM decoder) for acoustically reproducing PCM data, and a display device such as an LCD for displaying texts or images.

The track chunks include music score track chunks 102 to 105, a PCM audio track chunk 106, a graphics track chunk 107, and a master track chunk 108 in correspondence to the respective output devices. In this connection, the track chunks other than the master track chunk, namely, the score track chunks, the PCM audio track chunk, and the graphics track chunk can be described up to a maximum of 256 tracks.

In the shown example, the music score track chunks 102 to 105 contain music sequence data for commencing the sound generator device, the PCM track chunk 106 contains wave data such as ADPCM, MP3, and TwinVQ reproduced by the PCM sound generator device in event sequential format, and the graphics track chunk contains a background image, an inserted still image, text data, and sequence data for reproducing them by using the display device. The master track chunk 108 contains sequence data for controlling the SMAF sequencer itself.

As shown in this diagram, the HV track chunk 4 in the above data interchange format of the voice reproduction sequence data is stored in the extended SMAF file 100 together with the score track chunks 102 to 105, the PCM audio track chunk 106, and the graphics track chunk 107 in the above, thereby enabling a voice reproduction in synchronization with a performance of a piece of music and in synchronization with displaying an image or text. Therefore, for example, it becomes possible to achieve multimedia contents which can cause a sound generator to sing a song along with musical sounds.

Figure 3:
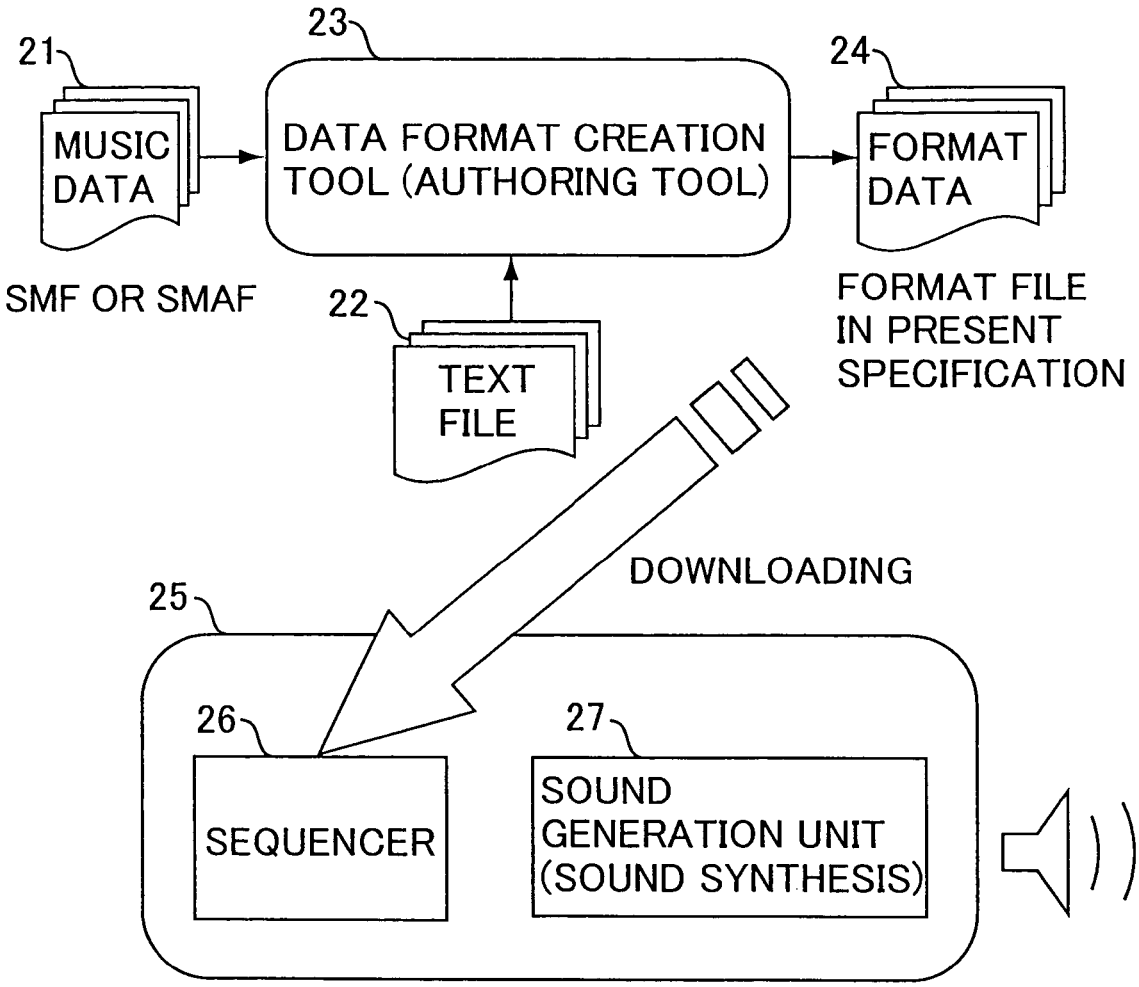
FIG. 3 is a diagram showing an example of an outline of a system for creating the data interchange format of the present invention and using a file in the data interchange format.

Referring to FIG. 3, there is shown a diagram of an example of an outline structure of a system for creating a file in the data interchange format according to the present invention shown in FIG. 2 and a system using the data interchange format file.

In FIG. 3, there are shown a music data file 21 of SMF or SMAF, a text file 22 corresponding to a voice to be reproduced, a data formatting tool (authoring tool) 23 for creating a file of the data interchange format according to the present invention, and a file 24 having the data interchange format of the present invention.

The authoring tool 23 inputs the text file 22 representing words for a voice sound synthesis, indicating pronunciation of the voice, and creates voice reproduction sequence data corresponding to the text. The authoring tool 23 then adds the created voice reproduction sequence data to the music data file 21 in SMF or SMAF to create the composite file (an extended SMAF file including the HV track chunk shown in FIG. 2 in the above) 24 based on the data interchange format specification of the present invention.

The created file 24 is transferred to a user equipment 25 (such as a portable communication terminal 51 described later) having a sequencer 26 for supplying a control parameter to a sound generator unit 27 at a timing defined by duration included in the sequence data. The sound generator unit 27 is provided for reproducing and outputting a voice on the basis of the control parameter supplied by the sequencer 26. Therefore, the voice sound is reproduced in synchronization with the music sound or the like.

Figure 4:
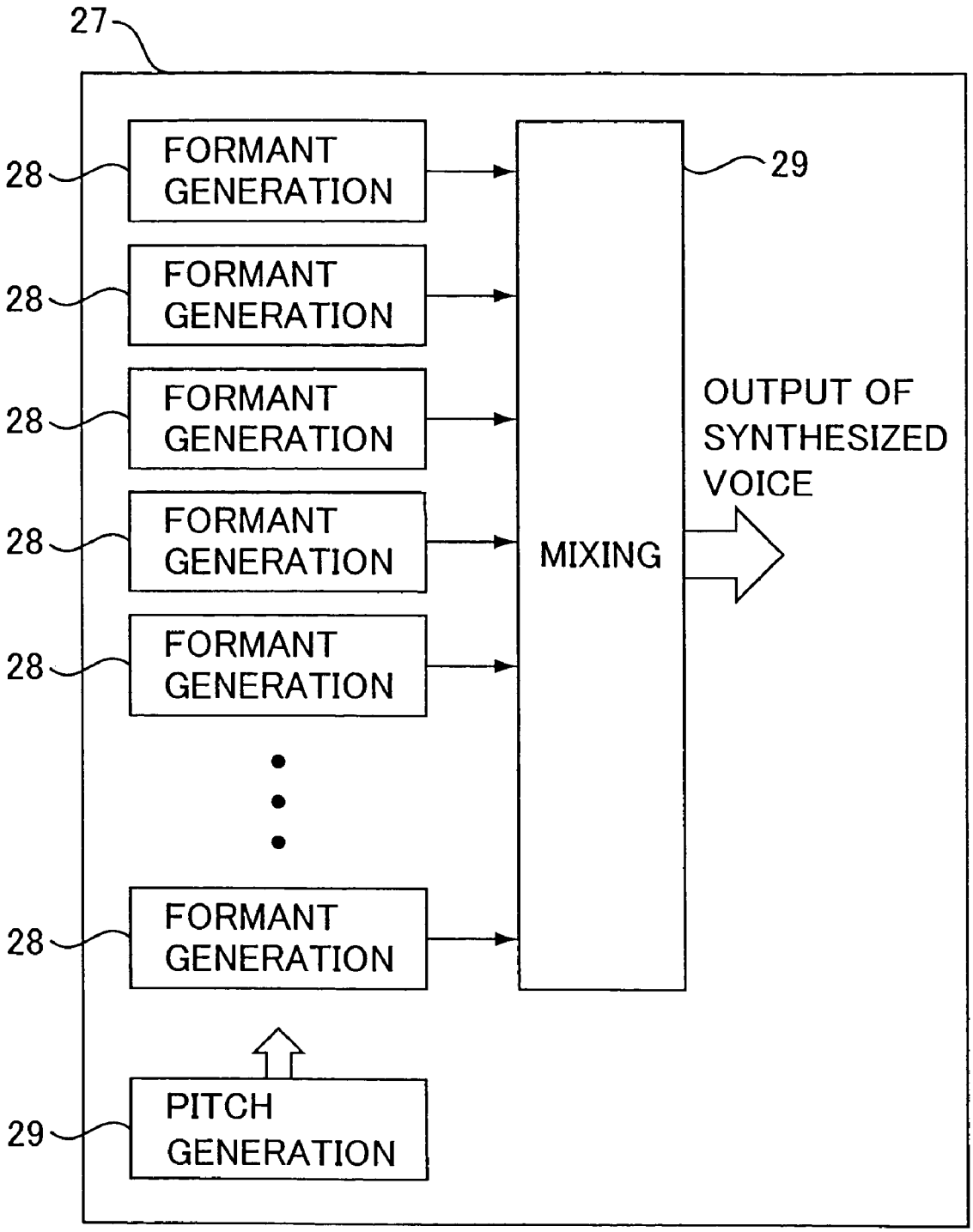
FIG. 4 is a diagram showing an example of an outline configuration of a sound generator device.

Referring to FIG. 4, there is shown a diagram of an outline configuration of the sound generator unit 27 as an example.

In the example shown in FIG. 4, the sound generator unit 27 has a plurality of formant generation units 28 and a pitch generation unit 29. The formant generation units 28 generate formant signals of the voice based on formant control information (formant frequency and level parameters for generating the formants) output from the sequencer 26 and based on pitch information. They are added in a mixing unit 30, thereby generating the corresponding voice sound synthesis output. The formant generation units 28 generate basic waveforms as a basis for generating the formant signals. For the generation of the basic waveforms, for example, a known waveform generator for a FM sound generator can be used.

As set forth in the above, in the present invention, three format types are prepared for the voice reproduction sequence data included in the above HV track chunk 4, and they can be appropriately selected for use. These format types will now be described hereinafter.

For describing a voice to be reproduced, there are various phases of description methods different in an abstraction level such as character information (text information) corresponding to the reproduced voice, pronunciation information (phonetic information) independent of a language, and formant information indicating a sound waveform itself. In the present invention, three format types are defined: (*a*) a text description type (TSeq type), (*b*) a phoneme description type (PSeq type), and (*c*) a formant frame description type (FSeq type).

First, differences of these three format types will be described below by referring to FIG. 5.

(*a*) Text Description Type (TSeq Type)

The TSeq type is a format type where a voice to be pronounced is described in a text representation, including a character code (text information) dependent on each language and prosodic symbols indicating vocal expressions such as an accent and the like of the voice. Data in this format can be directly generated using an editor. In reproduction, as shown in FIG. 5(*a*), sequence data of the TSeq type is first converted to the PSeq type through middleware processing (first conversion). Subsequently, the sequence data of the PSeq type is converted to the FSeq type (second conversion) and the converted result is output to the sound generator unit 27.

The first conversion of converting the TSeq type to the PSeq type is performed by referring to first dictionary data (stored in ROM or RAM of the apparatus) that contains a character code (for example, hiragana, katakana, or other text information), which is information depending on a language and associated prosodic symbols, and information indicating pronunciations (phonemes) independent of the language and prosodic control information for controlling the prosody in correspondence to the character code. The second conversion of converting the PSeq type to the FSeq type is performed by referring to second dictionary (stored in ROM or RAM of the apparatus) that contains phonemes and associated prosodic control information, and formant control information (parameters of formant frequencies, bandwidths, and levels for generating the formants) corresponding to the phonemes and associated prosodic control information.

(*b*) Phoneme Description Type (PSeq Type)

The PSeq type is a format type where information of a voice to be pronounced is described in a format similar to a MIDI event defined by SMF, with a phoneme unit base independent of a language as a phonetic description. As shown in FIG. 5(*b*), in data creation processing executed by using the authoring tool or the like, a data file of the TSeq type is first created and it is converted to the PSeq type through the first conversion. To reproduce the data file of the PSeq type, it is converted to the FSeq type through the second conversion executed as middleware processing, and the converted data file is output to the sound generator unit 27.

(*c*) Formant Frame Description Type (FSeq Type)

The FSeq type is a format type where formant control information is represented as a frame data string. As shown in FIG. 5(*c*), the data creation processing includes first conversion of the TSeq type to the PSeq type and the second conversion of the PSeq type to to the FSeq type. It is also possible to create data of the FSeq type through third conversion from sampled waveform data, which is the same processing as a normal voice analysis. In reproduction, the file of the FSeq type can be directly output to the sound generator for reproduction.

As set forth in the above, in the present invention, three format types different in an abstraction level are defined so that a desired type can be selected according to an individual case. Furthermore, the first conversion and the second conversion executed for the voice reproduction is executed as middleware processing, thereby decreasing a load on an application.

The following describes contents of the HV track chunk 4 (FIG. 1) in detail.

As shown in FIG. 1, each HV track chunk 4 contains data specifying a format type indicating which type of the three format types corresponds to the voice reproduction sequence data included in the HV track chunk, a language type indicating a language type in use, and a time base.

A list of examples of the format types is given in Table 1.

TABLE 1

| Format type | Description |
|---|---|
| 0x00 | TSeq type |
| 0x01 | PSeq type |
| 0x02 | FSeq type |

A list of examples of the language types is given in Table 2.

TABLE 2

| Language type | Description |
|---|---|
| 0x00 | Shift-JIS |
| 0x02 | EUC-KR (KS) |

While only a Japanese word (0x00: 0x represents a hexadecimal numeral, which is the same with hereinafter) and a Korean word (0x01) are shown here, words in Chinese, Taiwanese, English, and other languages can be defined similarly.

The time base defines a base time for duration and a gate time in the sequence data chunk included in the track chunk. While the time base is defined as 20 msec in this embodiment, it can be set to an arbitrary value.

TABLE 3

| Time base | Description |
|---|---|
| 0x11 | 20 msec |

Details of data of the above three format types will be further described below.

(*a*) TSeq Type (Format Type=0x00)

As set forth in the above, a sequence representation in the text representation (TSeq: text sequence) is used for this format type, including a sequence data chunk 5 and n (n is 1 or a greater integer) TSeq data chunks (TSeq #00 to TSeq #n) 6, 7, and 8 (FIG. 1). A reproduction of data included in the TSeq data chunk is specified by a voice reproduction event (Note On event) included in the sequence data.

(a-1) Sequence Data Chunk

Figure 6:
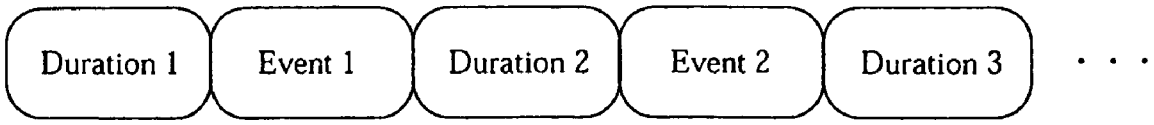
FIGS. 6(*a*) and 6(*b*) are diagrams showing a sequence data structure and a relation between duration and gate time.
Figure 6:
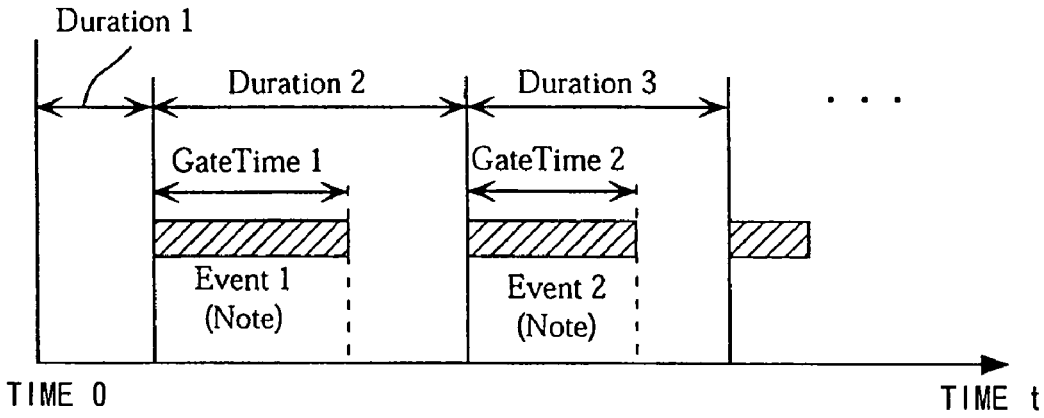

The sequence data chunk includes sequence data in which combinations of duration and an event are arranged in order of time similarly to the sequence data chunk in SMAF. Referring to FIG. 6(*a*), there is shown a diagram of a sequence data structure. The duration indicates a time between events. The first duration (Duration 1) indicates an elapsed time from time 0. Referring to FIG. 6(*b*), there is shown a diagram illustrating a relation between duration and a gate time included in a note message. As shown in this diagram, the gate time indicates a phonation time of its note message. The structure of the sequence data chunk shown in FIG. 6 is the same as in sequence data chunks in the PSeq type and the FSeq type.

There are the following three types of events as events to be supported by the sequence data chunk: initial values described hereinafter are default values for no event specification.

(a-1-1) Note Message "0x9n kk gt"

It is assumed here that "n" is a channel number (0x0 [fixed]), "kk" is a TSeq data number (0x00 to 0x7F), and "gt" is a gate time (1 to 3 bytes).

The note message is for use in interpreting a TSeq data chunk specified by a TSeq data number kk of a channel specified by a channel number n and starting phonation. Note that, however, the phonation is not performed for a note message having a gate time gt of zero (0).

(a-1-2) Volume "0xBn 0x07 vv"

It is assumed here that "n" is a channel number (0x0 [fixed]) and "vv" is a control value (0x00 to 0x7F). An initial value of a channel volume is 0x64.

The volume event is a message specifying a volume of a specified channel.

(a-1-3) Pan "0xBn 0x0A vv"

It is assumed here that "n" is a channel number (0x0 [fixed]) and "vv" is a control value (0x00 to 0x7F). An initial value of a pan pot is 0x40 (center).

The pan message specifies a stereo sound field position of a specified channel.

(a-2) TSeq Data Chunk (TSeq #00 to TSeq #n)

A TSeq data chunk is in a talking format including information on a language and a character code, settings of sounds to be pronounced, and pronunciation information (to be synthesized) as information for sound synthesis and described in a tag format. The TSeq data chunk is to be input in a text format to simplify user's inputs.

A tag begins with "<" (0x3C) followed by a control tag and a value. The TSeq data chunk is composed of a tag string. Note that, however, it includes no space and that "<" cannot be used for the control tag and the value. In addition, the control tag should be a single character without fail. A list of examples of the control tags and the valid values is given in Table 4 shown below.

TABLE 4

| | Tag | Value | Meaning |
|---|---|---|---|
| L | (0x4C) | Language | Language information |
| C | (0x43) | code | Character code name |
| T | (0x54) | Double-byte character string | Text for synthesis |
| P | (0x50) | 0- | Insertion of silence |
| S | (0x53) | 0-127 | Reproduction speed |
| V | (0x56) | 0-127 | Volume |
| N | (0x4E) | 0-127 | Pitch |
| G | (0x47) | 0-127 | Tone selection |
| R | (0x52) | None | Reset |
| Q | (0x51) | None | End |

The text tag "T" among the above control tags will now be described further.

A value following the text tag "T" is made of pronunciation information described in a double-byte hiragana character string (for Japanese) and prosodic symbols specifying vocal expressions (Shift-JIS code). A sentence having no sentence delimiter at an end of it is assumed to be the same as a sentence ending with "。".

The following prosodic symbols are preceded by a character of pronunciation information:

"い゛やーーー、き_よーわ゛さ_むい_ねー" (0x8141): Sentence delimiter (Normal intonation)

"。" (0x8142): Sentence delimiter (Normal intonation)

"?" (0x8148): Sentence delimiter (Questioning intonation)

"゛" (0x8166): Accent with high pitch(A changed value is effective up to a sentence delimiter.)

"_" (0x8151): Accent with low pitch (A changed value is effective up to a sentence delimiter.) "-" (0x815B): Prolonged sound (A previous sound is prolonged. A use of a plurality of the symbols causes a more prolonged sound.)

Figure 7:
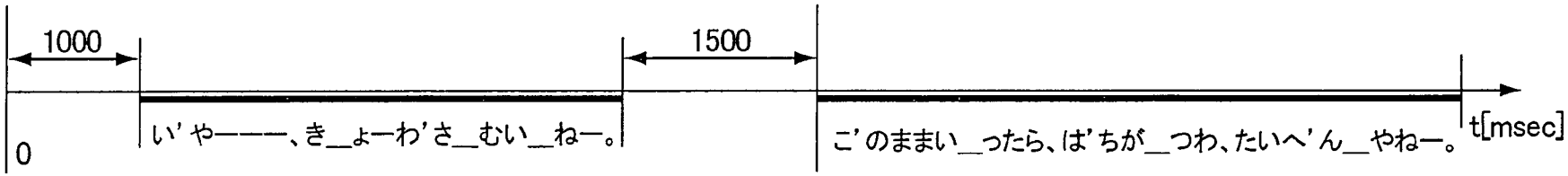
FIGS. 7(*a*) and 7(*b*) are a diagram showing an example of a TSeq data chunk and a diagram explaining reproduction time processing therefor.

Referring to FIG. 7(*a*), there is shown a diagram of an example of data in the TSeq data chunk. Referring to FIG. 7(*b*), there is shown a diagram for explaining its reproduction time processing.

The first tag "<LJAPANESE" indicates that the language is Japanese. "<CS-JIS" indicates that a character code is a shift JIS. "<G4", "<V1000", and "<N64" are used for specify a tone selection (a program change), a volume setting, and a pitch, respectively. "<T" indicates a text for a synthesis. "<P" indicates an insertion of a silence period in units of a millisecond defined by the value.

As shown in FIG. 7(*b*), the data in the TSeq data chunk are pronounced "こ゛のままい_たら、は゛ちが_つわ.(i'ya - - - ,ki_yo-wa'sa_mui_ne-.)" after a silence period of 1,000 msec from the start point specified according to duration, and then pronounced "た゛いへ゛ん_やねー(ko'nomamai_ttara, ha'tiga_tuwa,ta'ihe'n_yane-.)" after a silence period of 1,500 msec. In the above, corresponding accents or prolonged sounds are controlled according to "゛", "_", and "-".

In this manner, the TSeq type is a format type where a character code and vocal expressions (an accent and the like) for pronunciations specialized for each language are described in the tag format, and therefore this type of data can be directly created with an editor or the like. Therefore, a file in the TSeq data chunk can be easily processed on the text base. For example, it is possible to respond easily to a demand for a use of a dialect by modifying an intonation or processing the ending of a word in a described sentence. Furthermore, only a specific word in the sentence can be easily replaced with another word. Still further, this format type has an advantage of a small size data.

On the other hand, the TSeq type has disadvantages that a processing load is significantly imposed on interpreting data in the TSeq type data chunk and synthesizing sounds, that it is difficult to perform a finer pitch control, that it is not user-friendly when the format is expanded to add complicated definitions, and that it is dependent on a language (character) code (for example, while Shift-JIS is general for Japanese, for any other language the format need be defined with a character code corresponding to it).

(*b*) PSeq Type (Format Type=0x01)

The PSeq type is a format type using a sequence representation with phonemes (PSeq: phoneme sequence) similar to a MIDI event. This format is independent-of a language due to a description of phonemes. The phonemes can be represented by character information indicating pronunciations. For example, an ASCII code can be used so as to be common to a plurality of languages.

As shown in FIG. 1 in the above, the PSeq type includes a setup data chunk 9, a dictionary data chunk 10, and a sequence data chunk 11. It is used for instruct a reproduction of phonemes and prosodic control information of a channel specified by a voice reproduction event (note message) in the sequence data.

(b-1) Setup Data Chunk (Option)

The setup data chunk is for storing tone data or the like of a sound generator, containing a list of exclusive messages. In this embodiment, the contained exclusive messages are HV tone parameter registration messages.

The HV tone parameter registration message has a format of "0xF0 Size 0x43 0x79 0x07 0x7F 0x01 PC data . . . 0xF7", where "PC" is a program number (0x01 to 0x0F) and "data" is a HV tone parameter.

This message is for registering the HV tone parameter of the corresponding program number PC.

The HV tone parameters are listed in Table 5 as shown below.

TABLE 5

| | |
|---|---|
| #0 | Basic tone number |
| #1 | Pitch shift amount [Cent] |
| #2 | Formant frequency shift amount 1 |
| #3 | Formant frequency shift amount 2 |
| #4 | . . . |
| #5 | Formant frequency shift amount n |
| #6 | Formant level shift amount 1 |
| #7 | Formant level shift amount 2 |
| #8 | . . . |
| #9 | Formant level shift amount n |
| #10 | Operator waveform selection 1 |
| #11 | Operator waveform selection 2 |
| #12 | . . . |
| #13 | Operator waveform selection n |

As shown in Table 5, the HV tone parameters indicate a pitch shift amount, formant frequency shift amounts, formant level shift amounts, and operator waveform selection information for the first to n-th (n is 2 or a greater integer) formants. As described above, a processor has a preset dictionary (the second dictionary) containing phonemes and formant control information (formant frequencies, bandwidths, levels, and the like) corresponding to the phonemes. The HV tone parameters define shift amounts to parameters contained in the preset dictionary. It causes the same shift for all phonemes, thus enabling a change of a vocal quality of the voice to be synthesized.

With the HV tone parameters, tones can be registered by the number corresponding to 0x02 to 0x0F (namely, by the number of program numbers).

(b-2) Dictionary Data Chunk (Option)

The dictionary data chunk contains dictionary data corresponding to a language type such as, for example, dictionary data including differential data compared with the preset dictionary and phoneme data not defined in the preset dictionary. Thereby, it becomes possible to synthesize sounds with their own individual qualities having different tones.

(b-3) Sequence Data Chunk

The sequence data chunk contains sequence data in which combinations of duration and an event are arranged in order of time similarly to the sequence data chunk set forth in the above.

Events (messages) supported by the sequence data chunk in the PSeq type will be described below. The reading side ignores data other than these messages. Initial values described hereinafter are default values for no event specification.

(b-3-1) Note Message "0x9n Nt Vel Gatetime Size data . . . "

It is assumed here that "n" is a channel number (0x0 [fixed]), "Nt" is a note number (absolute value note specification: 0x00 to 0x7F, relative value note specification: 0x80 to 0xFF), "Vel" is a velocity (0x00 to 0x7F), "Gatetime" is a gate time length (variable), and "Size" is a size of a data section (variable length).

This note message starts phonation of sounds in a specified channel.

MSB of the note number is a flag for switching an interpretation between an absolute value and a relative value. Seven bits other than MSB indicate a note number. Since the sound phonation is performed only monaurally, the phonation is performed with giving priority to the last sound in case of overlapping of the gate time. In an authoring tool, it is preferable to place restrictions so as to prevent overlapped data from being created.

A data part contains phonemes and prosodic control information (pitch bend and volume) corresponding to them, having a data structure shown in Table 6 below.

TABLE 6

| | |
|---|---|
| #0 | Delay |
| #1 | Number of phonemes [=n] |
| #2 | Phoneme 1 |
| #3 | . . . |
| #4 | Phoneme n |
| #5 | Number of phoneme pitch bends [=N] |
| #6 | Phoneme pitch bend position 1 |
| #7 | Phoneme pitch bend 1 |
| #8 | . . . |
| #9 | Phoneme pitch bend position N |
| #10 | Phoneme pitch bend N |
| #11 | Number of phoneme volumes [=M] |
| #12 | Phoneme volume position 1 |
| #13 | Phoneme volume 1 |
| #14 | . . . |
| #15 | Phoneme volume position M |
| #16 | Phoneme volume M |

As shown in Table 6, the data part is composed of the number of phonemes n (#1), individual phonemes (phoneme 1 to phoneme n) (#2 to #4) described, for example, in the ASCII code, and prosodic control information. The prosodic control information includes pitch bends and volumes, comprising: pitch bend information (a phoneme pitch bend position 1 and a phoneme pitch bend 1 (#6 and #7) to a phoneme pitch bend position N and a phoneme pitch bend N (#9 and #10)) for specifying pitch bends of each of sections whose number N is defined by the number of phoneme pitch bends (#5) after separating the phonating section into the N sections regarding the pitch bends; and volume information (a phoneme volume position 1 and a phoneme volume 1 (#12 and #13) to a phoneme volume position M and a phoneme volume M (#15 and #16)) for specifying volumes of each of sections whose number M is defined by the number of phoneme volumes (#11) after separating the phonating section into the M sections regarding the volumes.

Figure 8:
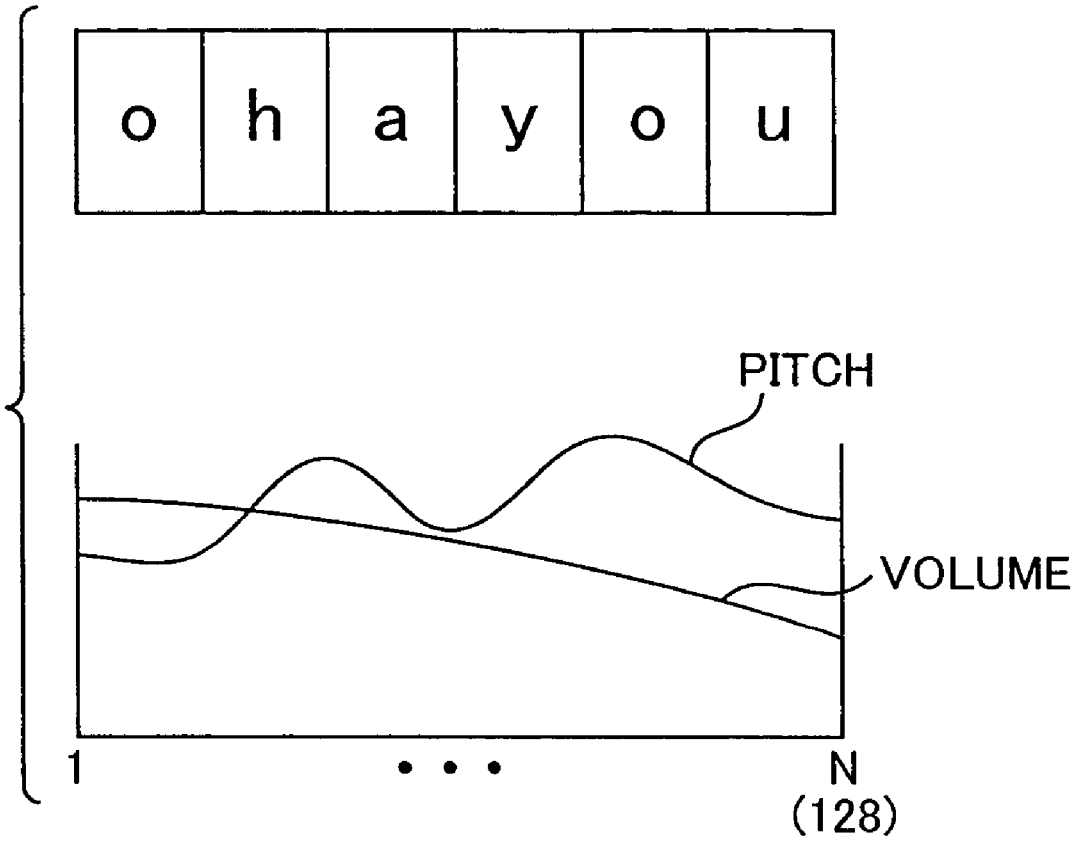
FIG. 8 is a diagram for explaining prosodic control information.

Referring to FIG. 8, there is shown a diagram for explaining the prosodic control information. In this embodiment, the prosodic control information is described by giving an example of character information "ohayou" to be pronounced. In addition, each of N and M is assumed to equal 128 (N=M=128). As shown in this diagram, the section corresponding to the character information to be pronounced ("ohayou") is divided into 128 (=N=M) sections and the pitches and volumes at respective points are represented by the above pitch bend information and the volume information for control of prosody.

Figure 9:
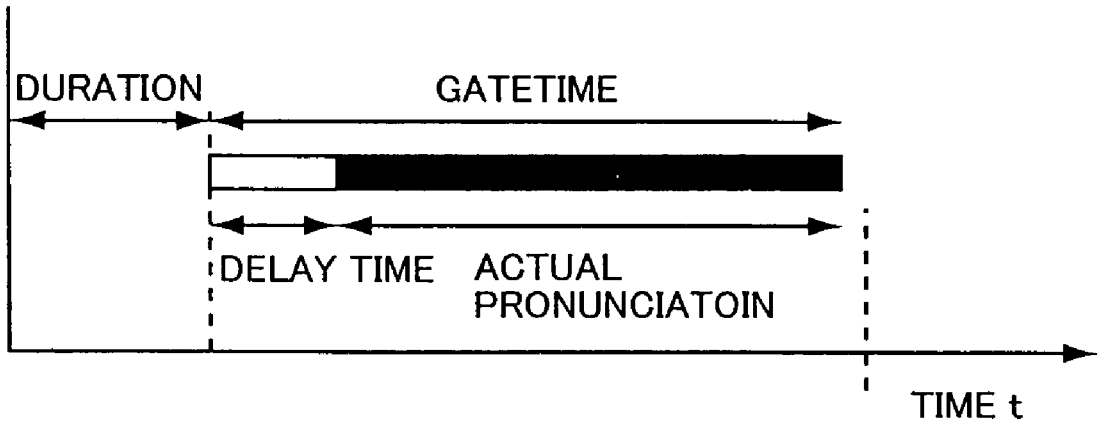
FIG. 9 is a diagram showing a relation between the gate time and the delay time.

Referring to FIG. 9, there is shown a diagram of a relation between the gate time length (Gatetime) and the delay time (Delay Time (#0)). As shown in this diagram, the delay time can be used to delay an actual phonation relative to the timing determined by the duration. It is assumed that "Gate time=0" means an inhibition.

(b-3-2) Program Change "0xCn pp"

It is assumed here that "n" is a channel number (0x0 [fixed]) and "pp" is a program number (0x00 to 0xFF). An initial value of the program number is assumed 0x00.

The program change message specifies a channel whose tone is to be preset. In this embodiment, the channel numbers are 0x00 (male voice preset tone), 0x01 (female voice preset tone), and 0x02 to 0x0F (extended tones).

(b-3-3) Control Change

There are the following control change messages.

(b-3-3-1) Channel Volume "0xBn 0x07 vv"

It is assumed here that "n" is a channel number (0x0 [fixed]) and "vv" is a control value (0x00 to 0x7F). An initial value of the channel volume is assumed 0x64.

The channel volume message is for use in specifying a volume of a specified channel and is intended for setting a volume balance of channels.

(b-3-3-2) Pan "0xBn 0x0A vv"

It is assumed here that "n" is a channel number (0x0 [fixed]) and "vv" is a control value (0x00 to 0x7F). An initial value of a pan pot is assumed 0x40 (center).

This message specifies a stereo sound field position of a specified channel.

(b-3-3-3) Expression "0xBn 0x0B vv"

It is assumed here that "n" is a channel number (0x00 [fixed]) and "vv" is a control value (0x00 to 0x7F). An initial value of the expression message is assumed 0x7F (the maximum value).

The message specifies a change of a volume set by a channel volume of a specified channel. It is used for changing the volume in the middle of a piece of music.

(b-3-3-4) Pitch Bend "0xEn 11 mm"

It is assumed here that "n" is a channel number (0x0 [fixed]), "11" is a bend value LSB (0x00 to 0x7F), and "mm" is a bend value MSB (0x00 to 0x7F). An initial value of the pitch bend is assumed 0x40 for MSB or 0x00 for LSB.

This message varies a pitch of a specified channel up and down. An initial value of a variation range (pitch bend range) is a ±2 half tone. Value 0x00/0x00 indicates the maximum downward pitch bend, while value 0x7F/0x7F indicates the maximum upward pitch bend.

(b-3-3-5) Pitch Bend Sensitivity "0x8n bb"

It is assumed here that "n" is a channel number (0x0 [fixed]) and "bb" is a data value (0x00 to 0x18). An initial value of the pitch bend sensitivity is 0x02.

The message sets a sensitivity of a pitch bend of a specified channel, in units of a half tone. For example, when bb is 01, a ±1 half tone (the pitch bend range is 2 half tones in total) is set.

As set forth hereinabove, the PSeq type is a format type where sound information is described in a format similar to a MIDI event with a phoneme unit base represented by character information indicating a pronunciation, having a data size larger than the TSeq type and smaller than the FSeq type.

Thereby, it has advantages such that a time-base fine pitch or volume can be controlled similarly to MIDI, that there is no dependency on language since information is described on the phoneme base, that tones (vocal qualities) can be finely edited, and that a control similar to MIDI can be performed, thus facilitating additional implementation to a conventional MIDI device.

On the other hand, it has disadvantages such that processing in a sentence or word level cannot be performed and that a processing load is significantly imposed on interpreting the format and synthesizing sounds though it is smaller than one in the TSeq type.

(*c*) Formant Frame Description (FSeq) Type (Format type=0x02)

The formant frame description type is a format type where formant control information (parameters of formant frequencies and gains for creating the formants) is represented as a frame data string. In other words, assuming that a formant of a sound to be phonated is fixed for a certain period of time (frame), a sequence representation (FSeq: Formant sequence) is used with updating formant control information (each formant frequency and gain) corresponding to a sound to be phonated for each frame. It is used for instructing a reproduction of data in the FSeq data chunk specified by the note message included in the sequence data.

This format type includes a sequence data chunk and n (n is 1 or a greater integer) FSeq data chunks (FSeq #00 to FSeq #n).

(c-1) Sequence Data Chunk

The sequence data chunk contains sequence data where combinations of duration and an event are arranged in order of time similarly to the sequence data chunk.

Hereinafter, events (messages) supported by the sequence data chunk will now be described. The reading side ignores data other than these messages. Initial values described below are default values for no event specification.

(c-1-1) Note Message "0x9n kk gt"

It is assumed here that "n" is a channel number (0x0 [fixed]), "kk" is a FSeq data number (0x00 to 0x7F), and "gt" is a gate time (1 to 3 bytes).

This message is for use in interpreting a FSeq data chunk of a FSeq data number of a specified channel and starting a phonation. Note that no phonation is performed for a note message having a gate time "0".

(c-1-2) Volume "0xBn 0x07 vv"

It is assumed here that "n" is a channel number (0x0 [fixed]) and "vv" is a control value (0x00 to 0x7F). An initial value of the channel volume is 0x64.

This message is for specifying a volume of a specified channel.

(c-1-3) Pan "0xBn 0x0A vv"

It is assumed here that "n" is a channel number (0x0 [fixed]) and "vv" is a control value (0x00 to 0x7F). An initial value of a pan pot is 0x40 (center).

This message is for specifying a stereo sound field position of a specified channel.

(c-2) FSeq Data Chunk (FSeq #00 to FSeq #n)

The FS data chunk is composed of a FSeq frame data string. In other words, sound information is cut for each frame having a predetermined time length (for example, 20 msec) and formant control information (formant frequency or gain) obtained by analyzing sound data within each frame period is represented as a frame data string representing sound data of each frame in this format.

The FSeq frame data string is shown in Table 7.

TABLE 7

| | |
|---|---|
| #0 | Operator waveform 1 |
| #1 | Operator waveform 2 |
| #2 | . . . |
| #3 | Operator waveform n |
| #4 | Formant level 1 |
| #5 | Formant level 2 |
| #6 | . . . |
| #7 | Formant level n |
| #8 | Formant frequency 1 |

TABLE 7-continued

| | |
|---|---|
| #9 | Formant frequency 2 |
| #10 | . . . |
| #11 | Formant frequency n |
| #12 | Voiced/unvoiced switching |

In Table 7, data #0 to #3 are used for specifying waveform types (sine wave, rectangular wave, and the like) of a plurality of (n in this embodiment) formants used for sound synthesis. Parameters #4 to #11 are used for defining formants by using formant levels (amplitude) (#4 to #7) and center frequencies (#8 to #11). Parameters #4 to #8 define the first formant (#0). Hereinafter, similarly parameters #5 to #7 and #9 to #11 define the second formant (#1) to the n-th formant (#3). A flag #12 indicates a voiced or unvoiced sound.

Figure 10:
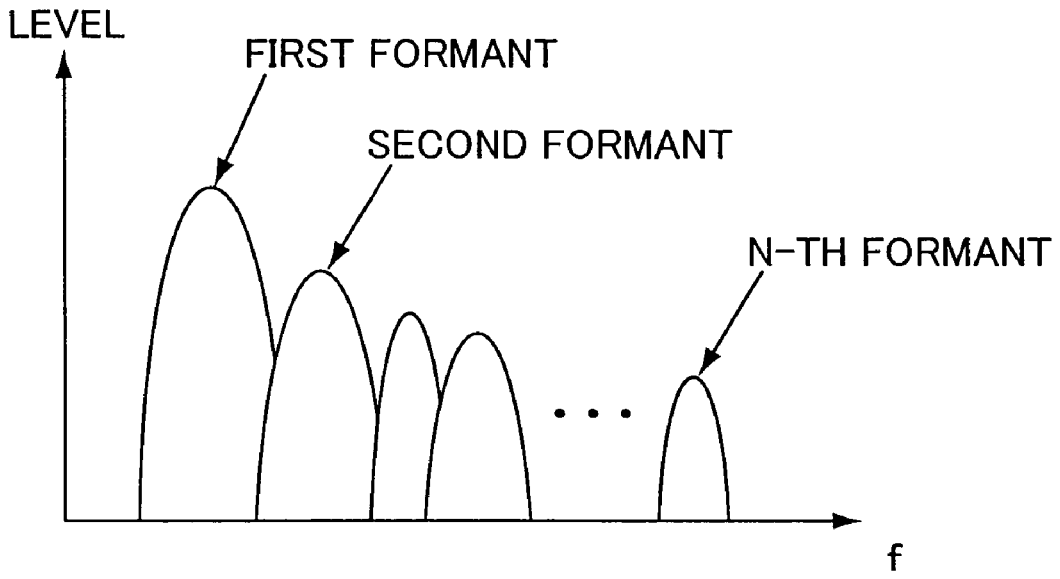
FIG. 10 is a diagram showing levels and center frequencies of formants.

Referring to FIG. 10, there is shown a diagram of the formant levels and the center frequencies. Data of n formants from the first to n-th formants are used in this embodiment. As shown in FIG. 4, the parameters and the pitch frequencies on the first to n-th formants for each frame are supplied to the formant generation units and the pitch generation unit of the sound generator unit 27 and then a sound synthesis output of the frame is generated and output as described above.

Figure 11:
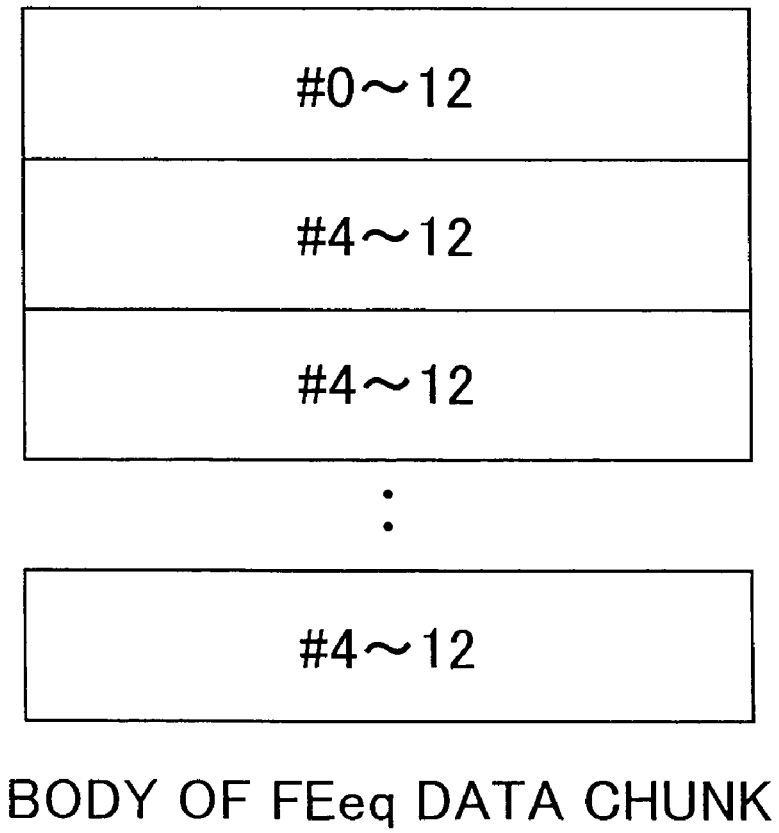
FIG. 11 is a diagram showing data of a body of a FSeq data chunk.

Referring to FIG. 11, there is shown a diagram illustrating data of the body of the FSeq data chunk. In the FSeq frame data string shown in Table 7, the data #0 to #3 are for use in specifying the waveform types of the formants and they need not be specified for each frame. Therefore, as shown in FIG. 11, all data shown in Table 7 should be specified for the first frame, while only data of #4 and after in Table 7 need be specified for the subsequent frames. With an arrangement of the body of the FSeq data chunk as shown in FIG. 11, the total number of data can be decreased.

In this manner, the FSeq type is a format type where the formant control information (frequencies and gains of the formants) is represented as a frame data string, and therefore a sound can be reduced by outputting the FSeq type file directly to the sound generator. Accordingly, there is no need for performing sound synthesis in the processing side, and the CPU is only required to perform frame updating at predetermined time intervals. Furthermore, by giving a certain offset to already stored phonation data, the tone (vocal quality) can be varied.

The FSeq type data, however, is hard to process at the sentence or word level, and it is impossible to edit fine tones (vocal qualities) and to change a time-base phonation length or formant displacement in the FSeq type data. Furthermore, while time-base pitch and volume can be controlled, it is difficult to control them since they are controlled with an offset of original data and the processing load is increased, disadvantageously.

The following describes a system using a file having the above data interchange format of the sequence data.

Figure 12:
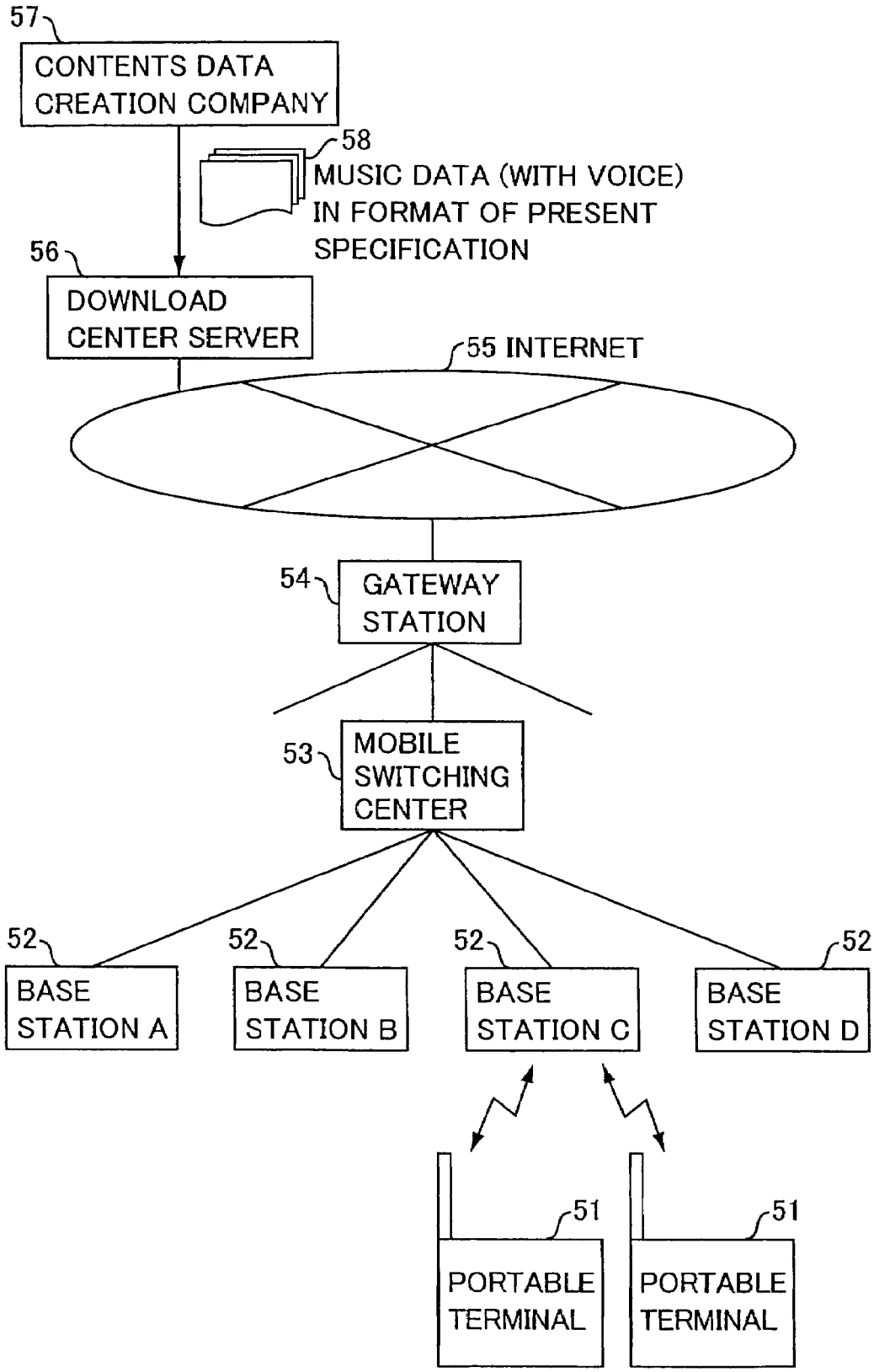
FIG. 12 is a diagram showing an example of an outline structure of a contents distribution system for distributing a file having the data interchange format of the present invention to portable communication terminals as one of sound reproducing apparatuses.

Referring to FIG. 12, there is shown a diagram of an outline structure of a contents data distribution system for distributing files in the above data interchange format to portable communication terminals as one of sound reproducing apparatuses for reproducing the voice reproduction sequence data described above.

In this diagram, there are shown the portable communication terminals 51, base stations 52, a mobile switching center 53 for controlling the plurality of base stations, a gateway station 54 for managing the plurality of mobile switching centers and serving as a gateway to a public network or any other fixed network or the Internet 55, and a server computer 56 of a download center connected to the Internet 55. Using a dedicated authoring tool or the like as described by referring to FIG. 3, the contents data creation company 57 creates a file having the data interchange format of the present invention from SMF or SMAF music data and a text file for sound synthesis and transfers it to the server computer 56.

The server computer 56 has files having the data interchange format of the present invention created by the contents data creation company 57 (an SMAF file including the HV track chunk and the like) and distributes music data including the corresponding voice reproduction sequence data in response to requests from users of the portable communication terminals 51 and those who access from computers not shown.

Figure 13:
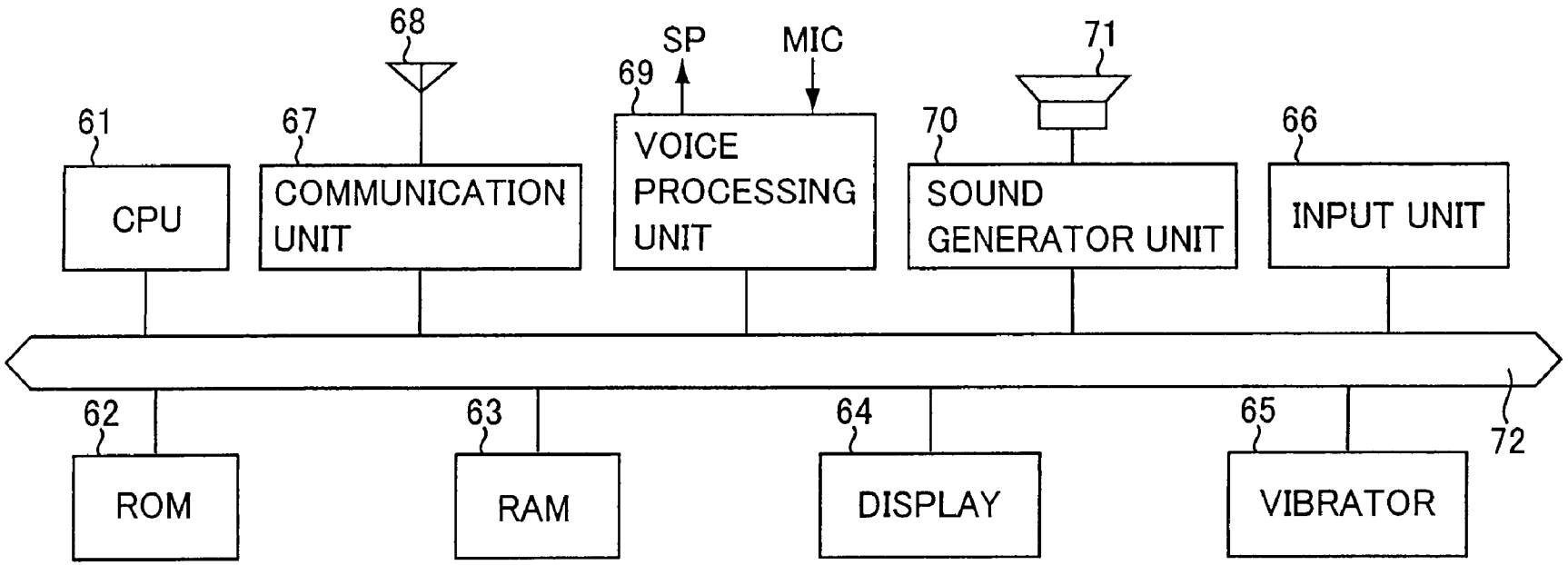
FIG. 13 is a block diagram showing an example of a configuration of the portable communication terminal.

Referring to FIG. 13, there is shown a block diagram illustrating a sample configuration of the portable communication terminal 51, which is an example of the sound reproducing apparatus.

In this diagram, there are shown a central processing unit (CPU) 61 for controlling the entire apparatus, a ROM 62 storing control programs such as various communication control programs and programs for music reproduction and various constant data, a RAM used as a work area and storing music files and various application programs, a display unit 64 including a liquid crystal display (LCD) and the like, a vibrator 65, an input unit 66 having a plurality of manual operation buttons or the like, and a communication unit 67 composed of a MODEM unit or the like connected to an antenna 68.

In addition, there is shown a voice processing unit 69 connected to a microphone for transmitting and to a speaker for receiving, and having functions of encoding and decoding speech signals for telephone calls. There is also shown a sound generator unit 70 for reproducing a piece of music on the basis of a music part contained in the music files stored in the RAM 63 and for reproducing voice sounds based on a voice part contained in the music files and then outputting both of the music sound and the voice sound to a speaker 71. There is also shown a bus 72 or performing a data transfer between the above components.

A user can access the download center server 56 shown in FIG. 12 using the portable communication terminal 51, download a file in the data interchange format of the present invention including voice reproduction sequence data of a desired type among the above three format types, and store it into the RAM 63. Thereafter, the user can reproduce the file directly or use it as a melody signaling an incoming call.

Figure 14:
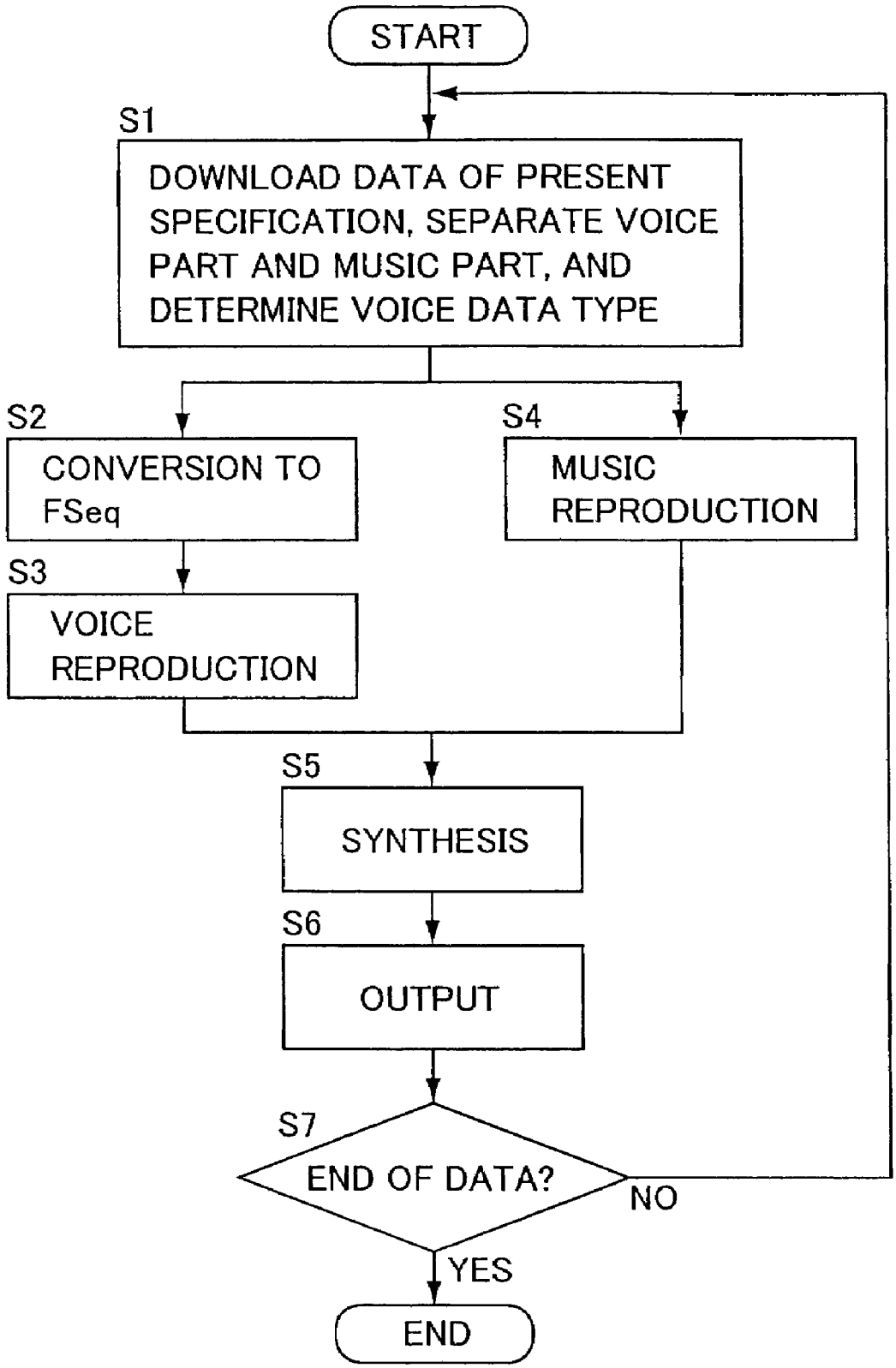
FIG. 14 is a flowchart showing a processing flow for reproducing a file having the data interchange format of the present invention.
Figure 15:
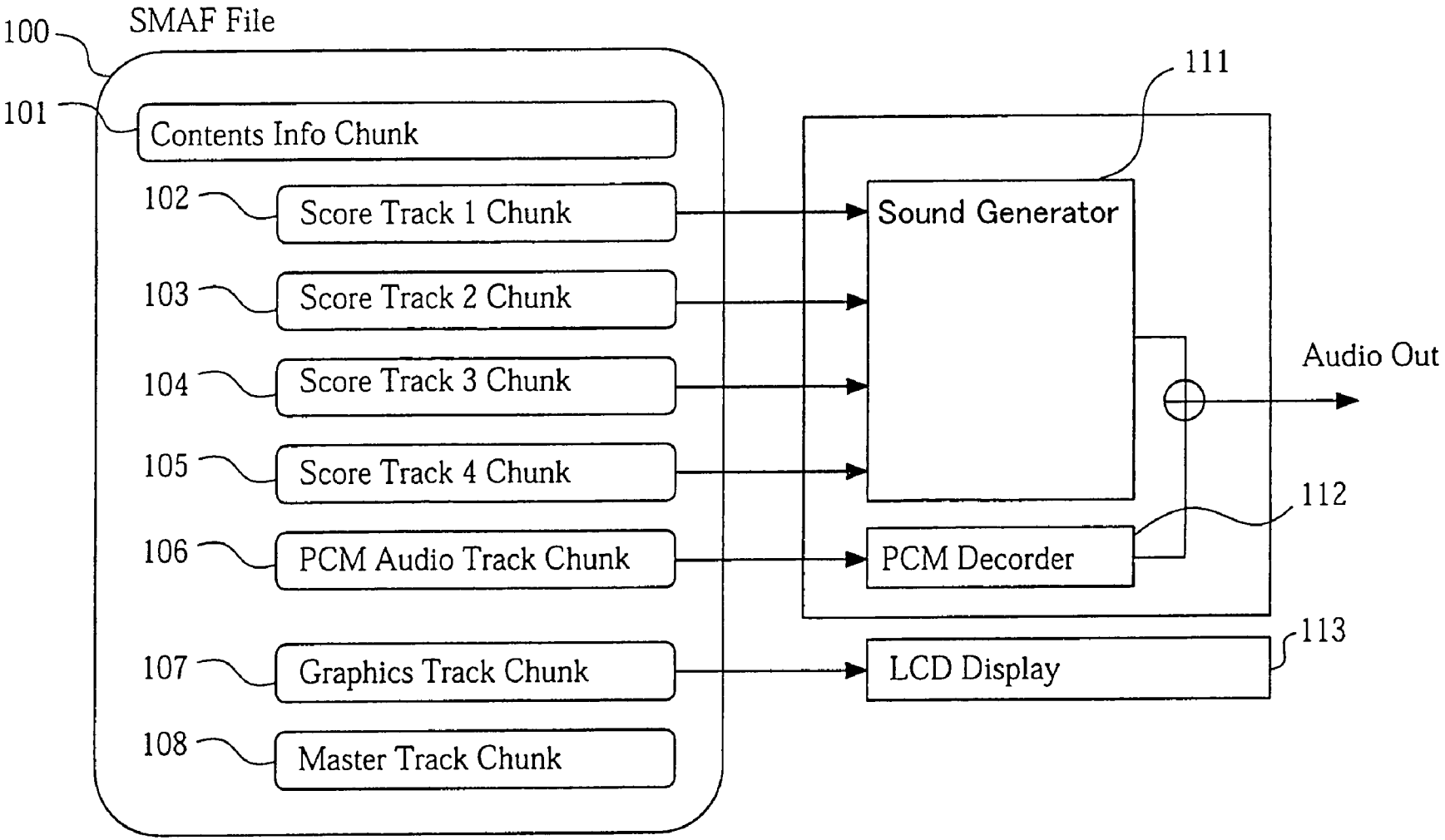
FIG. 15 is a diagram for explaining a concept of SMAF.

Referring to FIG. 14, there is shown a flowchart illustrating a processing flow of downloading a music file having the data interchange format of the present invention stored in the RAM 63 from the server computer 56 and reproducing the file. In the following description, the downloaded file is assumed to have the score track chunks and the HV track chunk in the format shown in FIG. 2.

When the processing starts upon receiving an instruction of starting music reproduction or at an occurrence of an incoming call where the file is used for a melody signaling the incoming call, CPU 61 reads out the downloaded file from the RAM 63, and separates a voice part (HV track chunk) and a music part (score track chunk) included in the downloaded from each other (step S1). Thereafter, the CPU 61 processes the voice part, such that the data is converted to FSeq data by performing the following processing according to the format type (step S2): (*a*) if the format is the TSeq type, the data is converted to FSeq type data by performing the first conversion of converting the TSeq type to the PSeq type and the second conversion of subsequently converting the PSeq type to the FSeq type, (*b*) if the format is the PSeq type, the data is converted to FSeq type data by performing the second conversion, and (*c*) if the format is the FSeq type, it is directly used, and then formant control data of the respective frames are updated for each frame time and is supplied to the sound generator 70 (step S3). On the other hand, for the music part, a sequencer included in the sound generator 70 interprets sound generation events such as note on events and program change events contained in the score track chunks, and musical tone generation parameters obtained by the interpretation are supplied to a sound generator unit of the sound generator 70 at a predetermined timing (step S4). Thereby, the voice sound and the music sound are synthesized (step S5) and output (step S6).

The first dictionary data used for the first conversion process and the second dictionary data used for the second conversion process are stored in either of ROM 62 and RAM 63.

Alternatively, the process of steps S1 through S3 may be carried out by the sequencer within the sound generator 70 rather than CPU 61. In such a case, the first dictionary data and the second dictionary data may be stored in within the sound generator 70. On the other hand, functions performed by the sequencer of the sound generator 70 at step S4 may be performed by CPU 61 in place of the sequencer.

As set forth by referring to FIG. 3, data in the data exchange format of the present invention can be created by adding the voice reproduction sequence data created based on the sound synthesis text data 22 to the existing music data 21 in SMF, SMAF, or the like. Thereby, the data interchange format can offer various entertainment-type services if it is used for a melody signaling an incoming call as described above.

While the sound reproducing apparatus is used for reproducing the voice reproduction sequence data downloaded from the server computer 56 of the download center in the above, it is also possible to create a file in the data interchange format of the present invention described above by using the sound reproducing apparatus.

In the portable communication terminal 51, the TSeq data chunk of the TSeq type corresponding to a text required to be phonated is input from the input unit 66. For example, an input is made as follows: "<Tお' っはよー、げ_んき" Then, it is used directly or the first or second conversion is performed to obtain voice reproduction sequence data of one of the above three format types and it is converted to a file in the data interchange format of the present invention and stored. Thereafter, the file is appended to e-mail and the e-mail is transmitted to the terminal of the other party.

The portable communication terminal of the other party that has received the e-mail interprets the type of the received file and performs the corresponding processing to reproduce the voice using the sound generator.

By processing data before transmission on the portable communication terminal in this manner, it becomes possible to offer various entertainment-type services. In this condition, a speech synthesis format type most suitable for the service concerned is selected in each processing method.

Furthermore, in recent years, generally a portable communication terminal has become capable of downloading and executing an application program in Java (TM). Therefore, more various types of processing can be performed by using the Java (TM) application program.

In other words, a text required to be phonated is input on the portable communication terminal. Then, the Java (TM) application program receives the input text data, pastes it with image data (for example, a talking face) matching the text, converts it to a file in the data interchange format of the present invention (a file having an HV track chunk and a graphics track chunk), and transmits the file from the Java (TM) application program to middleware (a sequencer and a software module controlling the sound generator or the image) via an API. The middleware interprets the transmitted file format and reproduces the voice with the sound generator while displaying the image in synchronization with the voice.

In this manner, the Java (TM) application program enables an offer of various entertainment-type services. In this condition, a speech synthesis format type most suitable for the service concerned is selected in each processing method.

While the voice reproduction sequence data format contained in the HV track chunk varies with three types in the above embodiment, the present invention is not limited to this. For example, as shown in FIG. 1, both of the TSeq type (*a*) and the FSeq type (*c*) have a sequence data chunk and the TSeq or FSeq data chunk, having the same basic structure. Therefore, it is possible to unify them and then to determine whether the data chunk concerned is a TSeq data chunk or an FSeq data chunk at a data chunk level.

In addition, all of the data definitions in the above tables are shown as an example only and therefore can be arbitrarily changed.

As set forth hereinabove, according to the data interchange format of the voice reproduction sequence data of the present invention, it is possible to represent a sequence for voice reproduction and to distribute or exchange voice reproduction sequence data to or between different systems or devices.

Furthermore, according to the data interchange format of the sequence data of the present invention where music sequence data and the voice reproduction sequence data exist in different chunks, it is possible to reproduce sounds while synchronizing the voice reproduction sequence and the music sequence by using a single format file.

Still further, the music sequence data and the voice reproduction sequence data can be described independently of each other, by which it is possible to sort only one of these from the other for reproduction easily.

Furthermore, according to the data interchange format of the present invention where one of three format types can be selected, it is possible to select the most suitable format type, taking into consideration uses of the sound reproduction or a load on the processing side.

What is claimed is:

1. An apparatus for reproducing a music sound and a voice sound representative of human voice, comprising:

a first storing section that stores a music data file containing a music part and a voice part, the music part containing a sequence of music generation events effective to instruct generation of the music sound, the voice part containing voice reproduction sequence data composed of a combination of voice reproduction event data and duration data, the voice reproduction event data being a text description type containing text information representing words to be pronounced as the human voice and prosodic symbols representing vocal expressions applied to pronunciation of the words, and instructing reproduction of a sequence of voice events, the duration data specifying a timing of effecting a voice event in terms of a duration time measured from another voice event preceding to the voice event;

a control section that reads out the music data file from the first storing section; and a sound generator section that operates based on the music part contained in the read music data file for generating the music sound representative of the sequence of the music events, and that operates based on the voice part contained in the read music data file for generating the voice sound representative of the sequence of the voice events, thereby mixing and outputting the music sound and the voice sound.

2. The apparatus according to claim 1, further comprising a second storing section that stores first dictionary data which records correspondence between the text information representing words to be pronounced as the human voice and phoneme information representing phonemes of the words, and correspondence between prosodic symbols representing vocal expressions applied to pronunciation of the words and the prosodic control information for controlling the vocal expressions, and a third storing section that stores second dictionary data which records correspondence between a combination of the phoneme information and associated prosodic control information representing the voice sound to be reproduced, and formant control information used for generating formants of the voice sound, wherein the control section reads out the music data file having the voice part containing the voice reproduction event data of the text description type, then the control section refers to the first dictionary data stored in the second storing section for acquiring therefrom the phoneme information and associated prosodic control information corresponding to the text information and associated prosodic symbols, and further refers to the second dictionary data stored in the third storing section for reading out therefrom the formant control information corresponding to the acquired phoneme information and associated prosodic control information, so that the sound generator section operates based on the read formant control information for generating the voice sound.

3. The apparatus according to claim 1, wherein the sound generator section is operable based on a voice part of another format for generating the voice sound, said another format of the voice part containing voice reproduction event data of a different description type than the voice reproduction event data of the text description type, and the control section for converting the voice reproduction event data of the text description type contained in the read voice part to the voice reproduction event data of the different description type, thereby enabling the sound generator section.

4. The apparatus according to claim 3, further comprising a second storing section that stores dictionary data required for conversion of the voice reproduction event data of the text description type contained in the voice part of the music data file, so that the control section refers to the dictionary data stored in the second storing section for effecting the conversion of the voice reproduction event data of the text description type contained in the read voice part.

5. The apparatus according to claim 1, wherein the voice part of the music data file contains data specifying a kind of language of the voice part.

6. A memory medium for storing voice reproduction sequence data designed for causing a sound generator device to reproduce a human voice, wherein the voice reproduction sequence data has a chunk structure composed of a content information chunk containing information for managing the voice reproduction sequence data and at least one track chunk containing voice sequence data, wherein the voice sequence data comprises a sequence of pairs of voice reproduction event data and duration data, the voice reproduction event data instructing a voice reproduction event of the human voice, the duration data specifying a timing of executing the voice reproduction event in terms of a duration time measured from a preceding voice reproduction event, and wherein the voice reproduction event data is one of a text description type, a phoneme description type and a formant frame description type, the text description type of the voice reproduction event data containing text information specifying words to be pronounced by the sound generator device as the human voice and associated prosodic symbols specifying vocal expression applied to pronunciation of the words, the phoneme description type of the voice reproduction event data containing phoneme information specifying phonemes of the human voice to be reproduced by the sound generator device and associated prosodic control information controlling vocal expressions of the phonemes, the formant frame description type of the voice reproduction event data containing formant control information specifying formants of the human voice at respective time frames.

7. A memory medium for storing sequence data for causing a sound generator device to reproduce a music sound and a human voice, wherein the sequence data has a data structure composed of music sequence data and voice reproduction sequence data, the music sequence data comprising a sequence of pairs of music generation event data and duration data, the music generation event data instructing a music generation event of the music sound, and the duration data specifying a timing of executing the music generation event in terms of a duration time measured from a preceding music generation event, and the voice reproduction sequence data comprising a sequence of pairs of voice reproduction event data and duration data, the voice reproduction event data instructing a voice reproduction event of the human voice, and the duration data specifying a timing of executing the voice reproduction event in terms of a duration time measured from a preceding voice reproduction event, whereby the music sequence data and the voice reproduction sequence data are concurrently processed by the sound generator device so as to reproduce the music sound and the human voice along a common time axis, wherein the voice reproduction event data is one of a text description type, a phoneme description type and a formant frame description type, the text description type of the voice reproduction event data containing text information specifying words to be pronounced by the sound generator device as the human voice and associated prosodic symbols specifying vocal expression applied to pronunciation of the words, the phoneme description type of the voice reproduction event data containing phoneme information specifying phonemes of the human voice to be reproduced by the sound generator device and associated prosodic control information controlling vocal expressions of the phonemes, the formant frame description type of the voice reproduction event data containing formant control information specifying formants of the human voice at respective time frames.

8. The memory medium according to claim 7, wherein the sequence data has a chunk structure such that the music sequence data and the voice reproduction sequence data are arranged at different chunks.

9. A server apparatus comprises a storing section and a transmitting section, wherein the storing section stores a music data file containing a music part and a voice part, the music part containing a sequence of music generation events effective to instruct generation of the music sound, the voice part containing voice reproduction sequence data composed of a combination of voice reproduction event data and duration data, the voice reproduction event data instructing reproduction of a sequence of voice events, the duration data specifying a timing of effecting a voice event in terms of a duration time measured from another voice event preceding to the voice event, and the transmitting section responds to a request from a client terminal apparatus for distributing the stored music data file to the client terminal apparatus, and wherein the voice reproduction event data is one of a text description type, a phoneme description type and a formant frame description type, the text description type of the voice reproduction event data containing text information specifying words to be pronounced by the sound generator device as the human voice and associated prosodic symbols specifying vocal expression applied to pronunciation of the words, the phoneme description type of the voice reproduction event data containing phoneme information specifying phonemes of the human voice to be reproduced by the sound generator device and associated prosodic control information controlling vocal expressions of the phonemes, the formant frame description type of the voice reproduction event data containing formant control information specifying formants of the human voice at respective time frames.

10. A method of controlling a music apparatus having a data storage and a sound generator for reproducing a music sound and a voice sound representative of a human voice, the method comprising the steps of:

storing a music data file containing a music part and a voice part in the data storage, the music part containing a sequence of music generation events effective to instruct generation of the music sound, the voice part containing voice reproduction sequence data composed of a combination of voice reproduction event data and duration data, the voice reproduction event data being a text description type containing text information representing words to be pronounced as the human voice and prosodic symbols representing vocal expressions applied to pronunciation of the words, and instructing reproduction of a sequence of voice events, the duration data specifying a timing of effecting a voice event in terms of a duration time measured from another voice event preceding to the voice event;

reading out the music data file from the data storage;

operating the sound generator based on the music part contained in the read music data file for generating the music sound representative of the sequence of the music events, and operating the sound generator based on the voice part contained in the read music data file for generating the voice sound representative of the sequence of the vice events, thereby mixing and outputting the music sound and the voice sound.

11. A computer program for use in a music apparatus having a data storage and a sound generator, the computer program being executable in the music apparatus for performing a method of reproducing a music sound and a voice sound representative of a human voice, wherein the method comprises the steps of:

storing a music data file containing a music part and a voice part in the data storage, the music part containing a sequence of music generation events effective to instruct generation of the music sound, the voice part containing voice reproduction sequence data composed of a combination of voice reproduction event data and duration data, the voice reproduction event data being a text description type containing text information representing words to be pronounced as the human voice and prosodic symbols representing vocal expressions applied to pronunciation of the words, and instructing reproduction of a sequence of voice events, the duration data specifying a timing of effecting a voice event in terms of a duration time measured from another voice event preceding to the voice event;

reading out the music data file from the data storage;

operating the sound generator based on the music part contained in the read music data file for generating the music sound representative of the sequence of the music events, and operating the sound generator based on the voice part contained in the read music data file for generating the voice sound representative of the sequence of the vice events, thereby mixing and outputting the music sound and the voice sound.

12. An apparatus for reproducing a voice sound representative of a human voice, said apparatus comprising:

a first storing section that stores a data file containing voice reproduction event data that is a text description type containing text information representing words to be pronounced as the human voice and prosodic symbols representing vocal expressions applied to pronunciation of the words, and which instructs reproduction of a sequence of voice events;

a second storing section that stores first dictionary data that records correspondence between the text information representing words to be pronounced as the human voice and phoneme information representing phonemes of the words, and correspondence between the prosodic symbols representing vocal expressions applied to pronunciation of the words and prosodic control information for controlling the vocal expressions;

a third storing section that stores second dictionary data that records correspondence between a combination of the phoneme information and associated prosodic control information representing the human voice to be reproduced, and formant control information used for generating formants of the human voice;

a control section that reads out the data file containing the voice reproduction event data of the text description type, then refers to the first dictionary data stored in the second storing section for acquiring therefrom the phoneme information and associated prosodic control information corresponding to the text information and associated prosodic symbols, and further refers to the second dictionary data stored in the third storing section for reading out therefrom the formant control information corresponding to the acquired phoneme information and associated prosodic control information; and a sound generator section that operates based on the read formant control information for generating the voice sound representative of the sequence of the voice events.

13. An apparatus for reproducing a voice sound representative of a human voice, comprising:

a storing section that stores a data file containing voice reproduction sequence data composed of a combination of voice reproduction event data and duration data, the voice reproduction event data instructing reproduction of a sequence of voice events, the duration data specifying a timing of effecting a voice event in terms of a duration time measured form another voice event preceding to the voice event, wherein the voice reproduction event data is one of a text description type, a phoneme description type and a formant frame description type, the text description type of the voice reproduction event data containing text information specifying words to be pronounced as the human voice and associated prosodic symbols specifying vocal expression applied to pronunciation of the words, the phoneme description type of the voice reproduction event data containing phoneme information specifying phonemes of the human voice to be reproduced and associated prosodic control information controlling vocal expressions of the phonemes, the formant frame description type of the voice reproduction event data containing formant control information specifying formants of the human voice at respective time frames;

a control section that reads out the data file from the storing section and processes the read data file; and a sound generator that operates based on the voice production sequence data contained in the processed data file for generating the voice sound representative of the sequence of the voice events based on the voice reproduction event data at the timing specified by the duration data.

* * * * *